US007489892B2

(12) United States Patent
Sano et al.

(10) Patent No.: US 7,489,892 B2
(45) Date of Patent: Feb. 10, 2009

(54) PARTICLE SUPPLY APPARATUS AND IMAGING APPARATUS HAVING A GAS SPOUTING UNIT FOR FLUIDIZING THE PARTICLES

(75) Inventors: Hiroshi Sano, Shizuoka (JP); Hirosato Amano, Shizuoka (JP); Keizo Chiba, Shizuoka (JP); Tetsuo Noji, Shizuoka (JP); Hiroshi Tateishi, Shizuoka (JP); Kazuhisa Sudo, Kanagawa (JP); Fumihito Itoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/679,964

(22) Filed: Feb. 28, 2007

(65) Prior Publication Data

US 2007/0201905 A1 Aug. 30, 2007

Related U.S. Application Data

(63) Continuation of application No. PCT/JP2006/319369, filed on Sep. 28, 2006.

(30) Foreign Application Priority Data

| | | |
|---|---|---|
| Oct. 4, 2005 | (JP) | 2005-291464 |
| Feb. 17, 2006 | (JP) | 2006-041350 |
| Feb. 27, 2006 | (JP) | 2006-049445 |
| Apr. 26, 2006 | (JP) | 2006-121395 |
| Apr. 26, 2006 | (JP) | 2006-121488 |

(51) Int. Cl.
*G03G 15/08* (2006.01)

(52) U.S. Cl. ..... 399/258; 399/262

(58) Field of Classification Search ..... 399/119, 399/120, 258, 262; 222/195, 630, DIG. 1
See application file for complete search history.

(56) References Cited

U.S. PATENT DOCUMENTS

| | | | | |
|---|---|---|---|---|
| 3,635,377 | A * | 1/1972 | Potvin | 222/145.7 |
| 3,642,178 | A * | 2/1972 | Balzau et al. | 406/90 |
| 4,109,027 | A * | 8/1978 | Crose | 427/476 |
| 4,111,492 | A * | 9/1978 | Mraz | 406/120 |
| 4,156,546 | A * | 5/1979 | Hine et al. | 406/23 |

(Continued)

FOREIGN PATENT DOCUMENTS

JP 9-185232 A 7/1997

(Continued)

OTHER PUBLICATIONS

U.S. Appl. No. 11/679,949, filed Feb. 28, 2007, Sano et al.

(Continued)

*Primary Examiner*—Robert Beatty
(74) *Attorney, Agent, or Firm*—Oblon, Spivak, McClelland, Maier & Neustadt, P.C.

(57) ABSTRACT

A particle supply apparatus is disclosed that includes a particle accommodating unit that accommodates particles, a gas spouting unit that is arranged at a bottom portion of the particle accommodating unit and is configured to spout gas toward the particles, a conveying mechanism that applies suction to the particles accommodated in the particle accommodating unit and conveys the particles toward a supply destination, and a gas discharge unit that discharges gas contained within the particle accommodating unit toward an exterior side of the particle accommodating unit.

14 Claims, 20 Drawing Sheets

U.S. PATENT DOCUMENTS

| | | | | |
|---|---|---|---|---|
| 5,727,607 | A | 3/1998 | Ichikawa et al. | |
| 5,909,609 | A | 6/1999 | Yahata et al. | |
| 5,950,055 | A | 9/1999 | Yahata et al. | |
| 5,950,062 | A | 9/1999 | Yahata et al. | |
| 5,960,246 | A | 9/1999 | Kasahara et al. | |
| 6,091,912 | A | 7/2000 | Kitajima et al. | |
| 6,567,637 | B2 * | 5/2003 | Yanagisawa et al. | 399/258 |
| 6,678,492 | B1 * | 1/2004 | Terazawa et al. | 399/258 |
| 6,679,301 | B2 | 1/2004 | Makino et al. | |
| 6,684,917 | B2 * | 2/2004 | Zhu et al. | 141/18 |
| 6,775,503 | B2 | 8/2004 | Hattori et al. | |
| 6,854,493 | B2 | 2/2005 | Ichikawa et al. | |
| 6,859,634 | B2 | 2/2005 | Itoh et al. | |
| 6,874,546 | B2 | 4/2005 | Amano et al. | |
| 2002/0020461 | A1 * | 2/2002 | Platsch | 141/153 |
| 2002/0144746 | A1 | 10/2002 | Makino et al. | |
| 2005/0244193 | A1 | 11/2005 | Amano et al. | |
| 2007/0223945 | A1 * | 9/2007 | Chiba et al. | 399/27 |

FOREIGN PATENT DOCUMENTS

| | | | |
|---|---|---|---|
| JP | 10-49025 | A | 2/1998 |
| JP | 2000-147879 | A | 5/2000 |
| JP | 2002-337801 | A | 11/2002 |
| JP | 3534159 | | 3/2004 |
| JP | 3549051 | | 4/2004 |
| JP | 2005-24622 | A | 1/2005 |
| JP | 2005-67651 | | 3/2005 |
| JP | 2005-173388 | | 6/2005 |
| JP | 2005-215655 | | 8/2005 |

OTHER PUBLICATIONS

U.S. Appl. No. 11/683,656, filed Mar. 8, 2007, Itoh et al.
U.S. Appl. No. 11/683,253, filed Mar. 7, 2007, Itoh et al.
U.S. Appl. No. 11/736,296, filed Apr. 17, 2007, Sano.
U.S. Appl. No. 11/911,598, filed Oct. 15, 2007, Sano et al.
U.S. Appl. No. 11/925,266, filed Oct. 26, 2007, Koinuma et al.
U.S. Appl. No. 12/018,611, filed Jan. 23, 2008, Sano.

* cited by examiner

PARTICLE SUPPLY APPARATUS AND IMAGING APPARATUS HAVING A GAS SPOUTING UNIT FOR FLUIDIZING THE PARTICLES

CROSS-REFERENCE TO RELATED APPLICATION

This application is a U.S. continuation application filed under 35 USC 111(a) claiming benefit under 35 USC 120 and 365(c) of PCT application JP2006/319369, filed Sep. 28, 2006, which claims priority to Japanese Patent Application Serial No. 2005-291464 filed on Oct. 4, 2005, Japanese Patent Application Serial No. 2006-041350 filed on Feb. 17, 2006, Japanese Patent Application Serial No. 2006-049445 filed on Feb. 27, 2006, Japanese Patent Application Serial No. 2006-121395 filed on Apr. 26, 2006, and Japanese Patent Application Serial No. 2006-121488 filed on Apr. 26, 2006. The foregoing applications are hereby incorporated herein by reference in their entirety.

BACKGROUND OF THE INVENTION

1. Field of the Invention

The present invention relates to a particle supply apparatus that supplies particles such as toner to a particle supply destination, an electrophotographic imaging apparatus such as a copier, a printer, a facsimile machine, or a multi-function machine that includes such a particle supply apparatus, and a monitoring system that monitors such an imaging apparatus over a network.

2. Description of the Related Art

Technology related to a particle supply apparatus such as a toner bank or a toner replenishing apparatus used for accommodating large amounts of toner in an imaging apparatus such as a copier or a printer are disclosed in Japanese Patent No. 3534159 and Japanese Laid-Open Patent Publication No. 2005-24622, for example.

In Japanese Patent No. 3534159, a particle supply apparatus (toner bank) that can accommodate plural toner container bottles is disclosed. Specifically, according to this disclosure, a stopper of one of the plural toner containers is removed so that toner contained therein may be supplied to a hopper of the toner bank. The toner within the hopper of the toner bank is conveyed to a developing apparatus corresponding to a toner supply destination by gas flow transferring means. Then, when the opened toner container becomes empty, another toner container is opened and toner is supplied from this other toner container to the toner bank.

In Japanese Laid-Open Patent Publication No. 2005-24622, a particle supply apparatus (toner replenishing apparatus) that includes a hopper (toner hopper) having a larger capacity than a toner container is disclosed. Specifically, according to this disclosure, toner from plural toner containers is accommodated within a toner hopper having a large capacity. The hopper has a stirring member that stirs the toner accommodated therein. The toner within the hopper is discharged from the lower side of the hopper and is conveyed toward a developing apparatus corresponding to the toner supply destination by fluid transporting means.

Also, Japanese Patent No. 3549051 discloses a particle supply apparatus (replenishing apparatus) for replenishing toner (particles) in a toner container (particle container). Specifically, according to this disclosure, air is supplied to the replenishing apparatus in order to increase the internal pressure of the apparatus so that toner accommodated within the replenishing apparatus may be discharged from a particle emission tube and supplied to a toner container corresponding to a toner supply destination.

The particle supply apparatus disclosed in Japanese Patent No. 3534159 accommodates plural toner containers in order to increase its toner accommodating capacity. However, when all the toner contained in the plural toner containers are used up, plural replacement toner containers have to be reinstalled into the apparatus which may be quite burdensome. In this respect, although toner accommodating capacity may be increased in the particle supply apparatus, operations required after all the toner is used up may be rather inefficient according to this technique.

The particle supply apparatus disclosed in Japanese Laid-Open Patent Publication No. 2005-24622 increases the toner accommodating capacity by increasing the capacity of the hopper. However, according to this technique, the toner accommodated in the hopper is mechanically stirred by a stirring member in order to prevent cross-linking of the toner, and as a result, mechanical stress may occur in the toner. When mechanical stress occurs in the toner, additives mixed to the toner may emerge onto the toner surface and/or be separated from the toner so that the toner may be degraded to cause image quality degradation. Further, since the particle supply apparatus of Japanese Laid-Open Patent Publication No. 2005-24622 discharges toner from the lower side of the hopper, the toner scattering amount from the particle supply apparatus may be increased when the seal around the toner discharge outlet is degraded, for example.

The particle supply apparatus disclosed in Japanese Patent No. 3549051 actively applies pressure to an accommodating portion that accommodates toner in order to enable discharge of the toner. Accordingly, the accommodating portion has to have adequate mechanical durability for withstanding the pressure applied thereto. In this respect, although the particle supply apparatus according to this technique may be used as a fabricating apparatus that replenishes toner to a toner container, it may not be suitable for use as a particle supply apparatus of an imaging apparatus that supplies toner to a developing apparatus.

Also, it is noted that in the case of using the technique of actively applying pressure to the toner accommodating portion to discharge the toner from the accommodating portion, the discharge amount of toner may vary significantly depending on the amount of toner remaining in the accommodating portion, and it may be difficult to perform fine adjustment of the toner discharge amount. Thus, although the particle supply apparatus of Japanese Patent No. 3549051 may be used as a fabricating apparatus that replenishes toner to a toner container, it may not be suitable for use as a particle supply apparatus of an imaging apparatus that supplies toner to a developing apparatus.

It is noted that the problems described above are not merely problems encountered by a particle supply apparatus used in an imaging apparatus. That is, the problems are common to all types of particle supply apparatuses that demands fine adjustment of the particle supply amount without damaging the particles.

Also, for such particle supply apparatuses, a technique is in demand for efficiently and accurately supplying particles to a supply destination while preventing scattering of the particles accommodated within a particle accommodating portion.

SUMMARY OF THE INVENTION

According to an aspect of the present invention, a technique that may be applied to a particle supply apparatus and an imaging apparatus is provided for increasing particle accommodating capacity without damaging the particles or requiring burdensome replacement procedures, enabling fine adjustment of the particle supply amount, and transporting particles to a particle supply destination in an efficient and accurate manner without causing particle scattering.

According to one embodiment of the present invention, a particle supply apparatus is provided that includes:

a particle accommodating unit that accommodates particles;

a gas spouting unit that is arranged at a bottom portion of the particle accommodating unit and is configured to spout gas toward the particles;

a conveying mechanism that applies suction to the particles accommodated in the particle accommodating unit and conveys the particles toward a supply destination; and a gas discharge unit that discharges gas contained within the particle accommodating unit toward an exterior side of the particle accommodating unit.

According to another embodiment of the present invention, an imaging apparatus is provided that includes a particle supply apparatus according to an embodiment of the present invention.

DESCRIPTION OF THE PREFERRED EMBODIMENTS

Figure 1:
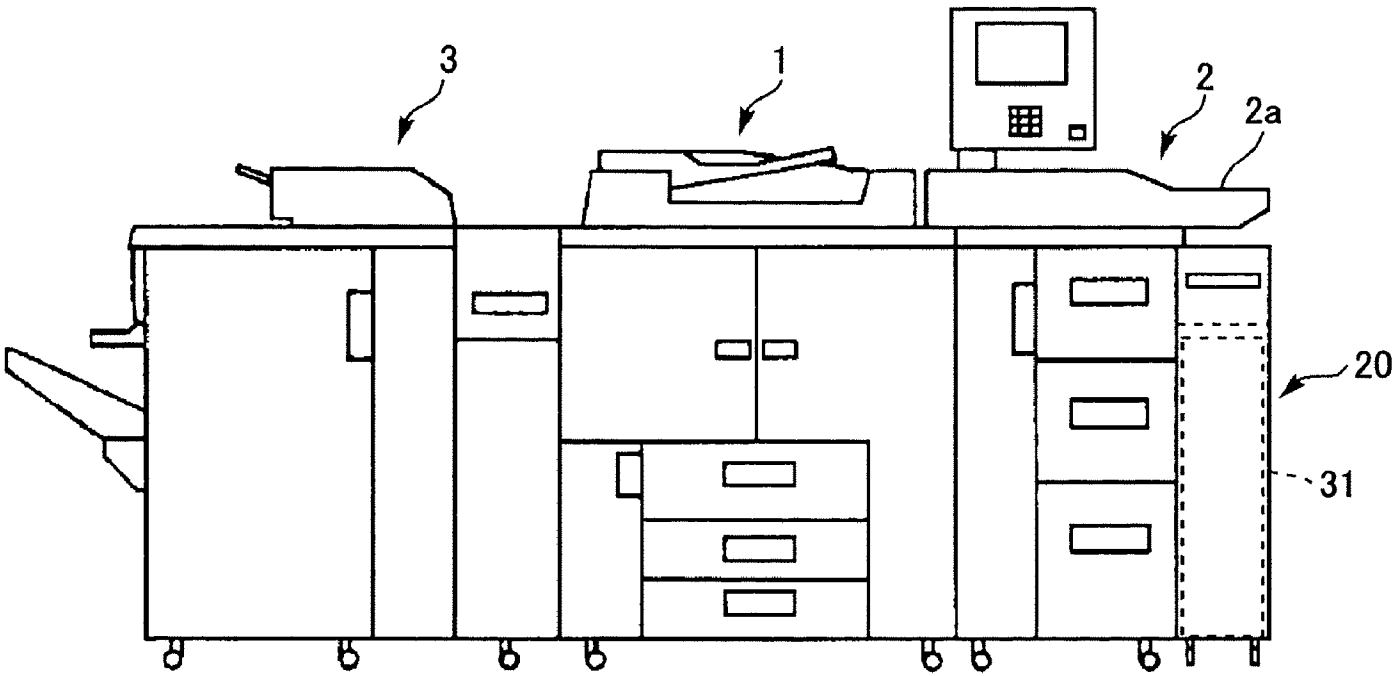
FIG. 1 is a diagram showing an external configuration of an imaging apparatus according to a first embodiment of the present invention.

In the following, preferred embodiments of the present invention are described with reference to the accompanying drawings. It is noted that in these drawings, illustrated elements that have identical or corresponding features are represented by identical reference numerals and overlapping descriptions may be omitted or simplified.

First Embodiment

In the following, a first embodiment of the present invention is described with reference to FIGS. 1-9.

First, the overall configuration and operations of an imaging apparatus according to the first embodiment are described with reference to FIGS. 1 and 2.

FIG. 1 is a diagram illustrating an external configuration of the imaging apparatus according to the first embodiment. FIG. 2 is a diagram illustrating internal configurations of an imaging apparatus main frame and a particle supply apparatus.

In FIG. 1, an imaging apparatus main frame (copying unit) 1, a paper feed bank (paper feed unit) 2, a post process unit 3 that performs post processes such as sorting and stapling, and a particle supply apparatus (toner supply unit) 20 are illustrated as components of the imaging apparatus according to the present embodiment.

The particle supply apparatus 20 is arranged at the bottom side of a wing 2*a* of a paper feed tray that is placed on top of the paper feed bank 2.

Figure 2:
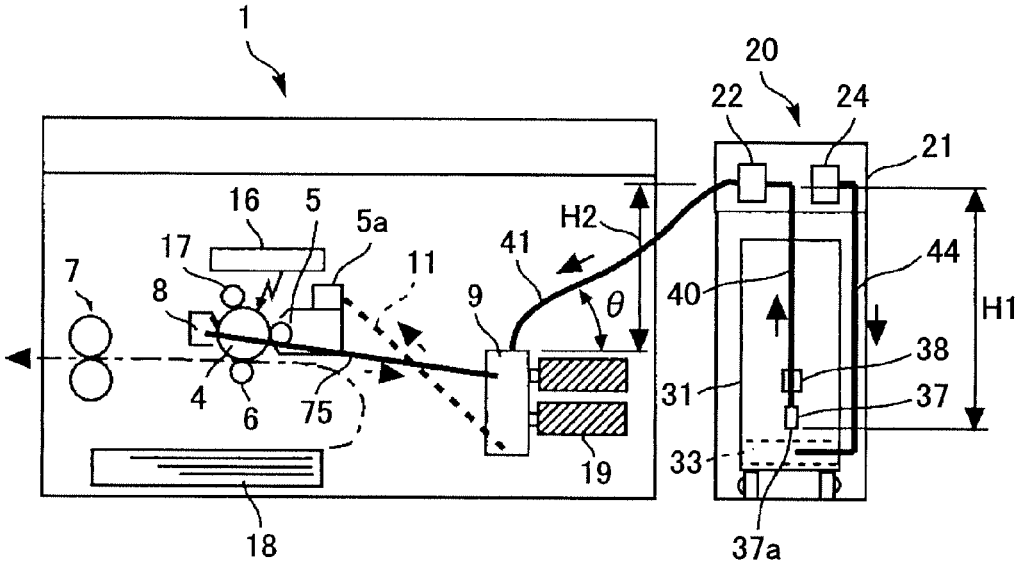
FIG. 2 is a diagram showing configurations of an imaging apparatus main frame and a particle supply apparatus according to the first embodiment.

In FIG. 2, the internal configurations of the imaging apparatus main frame 1 and the particle supply apparatus 20 are shown. Specifically, the imaging apparatus main frame 1 includes a photoconductor drum 4 as an image holding element, a developing unit (developer) 5 that develops a latent image formed on the photoconductor drum 4, a transfer unit 6 that transfers a toner image formed on the photoconductor drum 4 onto a recording medium such as paper, a fixing unit 7 that fixes toner that is transferred onto the recording medium, a cleaning unit 8 that collects untransferred toner that is remaining on the photoconductor drum 4, an exposure unit 16 that irradiates exposure light on the photoconductor drum 4 based on image information read by a document read unit, a charge unit 17 that charges the surface of the photoconductor drum 4, and a paper feed unit 18 that accommodates recording medium such as paper.

The imaging apparatus main frame 1 also includes a toner hopper (toner receiving unit) 9 as a supply destination for the toner being supplied from the particle supply apparatus 20, a toner conveying channel 11 for conveying the toner within the toner hopper 9 to a toner replenishing unit 5*a* of the developing unit 5, and toner containers (toner bottles) 19 as a secondary particle accommodating unit that supplies toner to the toner hopper 9 in addition to the particle supply apparatus 20.

Further, the imaging apparatus main frame 1 includes a supply channel (recycling channel) 75 as a recycling route for conveying the untransferred toner collected by the cleaning unit 8 to the toner hopper 9. In certain embodiments, the supply channel 75 may use a conveyor screw or a pump such as a diaphragm air pump, for example.

In the following, normal imaging operations of the imaging apparatus according to the present embodiment are described with reference to FIG. 2.

First, a document is conveyed by a conveying roller of a document conveying unit from a document table to pass a document read unit. At this point, the document read unit optically reads image information of the passing document.

Then, the optical image information read by the document read unit is converted into an electrical signal to be transmitted to the exposure unit 16. In turn, the exposure unit 16 irradiates exposure light such as laser on the photoconductor drum 4 based on the electrical signal of the image information.

The photoconductor drum 4 rotates in the clockwise direction in FIG. 2. The surface of the photoconductor drum 4 is evenly charged by the charge unit 17 when it reaches the position opposing the charge unit 17. The surface of the photoconductor 4 charged by the charge unit 17 then reaches an exposure light irradiation position, and a latent image corresponding to the image information is formed at this irradiation position.

Then, the surface of the photoconductor drum 4 having the latent image formed thereon reaches a position opposing the developing unit 5 at which position the latent image on the photoconductor drum 4 is developed into a toner image by the developing unit 5.

In the developing unit 5, toner supplied from the toner replenishing unit 5*a* is mixed with a carrier by a paddle roller, for example. Then, the frictionally charged toner and the carrier are supplied to the surface of a developing roller opposing the photoconductor drum 4.

It is noted that toner in the developing unit 5 may be replenished by the toner replenishing unit 5*a* as is necessary in accordance with the consumption of toner within the developing unit 5. The consumption of toner within the developing unit 5 may be detected by a photo sensor arranged opposite the photoconductor 4 or a magnetic permeability sensor arranged within the developing unit 5, for example. The toner in the toner replenishing unit 5*a* may be replenished by supplying toner from the toner hopper 9 via the toner conveying channel 11 that uses a toner conveying coil or a particle pump, for example. The toner in the toner hopper 9 may be replenished by supplying toner from the particle supply apparatus 20 arranged outside the imaging apparatus main frame 1 using conveying mechanism 37, 40, 22, and 41.

According to the present embodiment, plural replaceable toner containers 19 are arranged at the toner hopper 9 so that toner may be supplied to the toner hopper 9 from the toner containers 19 as well as the particle supply apparatus 20. For example, the toner containers 19 may be used to supply toner to the toner hopper 9 when replacement operations for replacing a particle accommodating unit 31 of the particle supply unit 20 are being performed. In this way, downtime of the imaging apparatus may be avoided.

Also, according to the present embodiment, the toner containers 19 are bottle-shaped containers having spiral projecting portions formed at their inner surfaces. Thus, by rotating the toner container 19, toner within the toner container 19 may be discharged from the opening of the toner container 19 to be supplied to the toner hopper 9.

Then, the surface of the photoconductor drum 4 having the toner image developed by the developing unit 5 reaches a position opposing the transfer unit 6 at which position the transfer unit 6 transfers the toner image formed on the photoconductor drum 4 onto a recording medium such as paper. In this case, a small amount of untransferred toner remains on the surface of the photoconductor drum 4.

Then, the surface of the photoconductor drum 4 having the untransferred toner remaining thereon reaches a position opposing the cleaning unit 8 at which position the untransferred toner is removed by a cleaning blade of the cleaning unit 8 that comes into contact with the surface of the photoconductor drum 4 so that the remaining toner may be collected by the cleaning unit 8. The toner collected by the cleaning unit 8 is conveyed to the toner hopper 9 via the supply channel 75 as recycled toner and is supplied to the developing unit 5 (toner replenishing unit 5*a*) along with fresh toner supplied from the particle supply unit 20 and/or the toner containers 19. In this way, efficient recycle of toner may be realized in the imaging apparatus.

Then, the surface of the photoconductor drum 4 that has passed the cleaning unit 8 reaches a charge removal position (not shown) where the electric potential on the surface of the photoconductor drum 4 is removed so that the imaging operations may be ended.

In the following, operations for handling the recording medium conveyed to the transfer unit 6 are described.

First, one paper feed unit (e.g. paper feed unit 18) is manually or automatically selected from plural paper feed units.

Then, one piece of the recording medium (e.g. paper) accommodated in the selected paper feed unit 18 is moved in the direction of the dot-dashed line shown in FIG. 2 representing a paper conveying route.

Then, the recording medium fed from the paper feed unit 18 is conveyed to the position where a resist roller is arranged. The recording medium reaching the position of the resist roller is synchronized with the photoconductor drum 4 to adjust the positioning of the toner image and is conveyed to the transfer unit 6.

After transfer of the toner image onto the recording medium is completed, the recording medium moves past the transfer unit 6 to reach the position of the fixing unit 7. At this position, the toner image transferred onto the recording medium is fixed by the fixing unit 7 using heat and pressure. Then, after undergoing the fixing process, the recording medium is discharged from the imaging apparatus main frame 1 as an output image and delivered to the post process unit 3 that performs post processes on the discharged recording medium.

In the following, the configuration and operations of the particle supply apparatus 20 are described.

Figure 3:
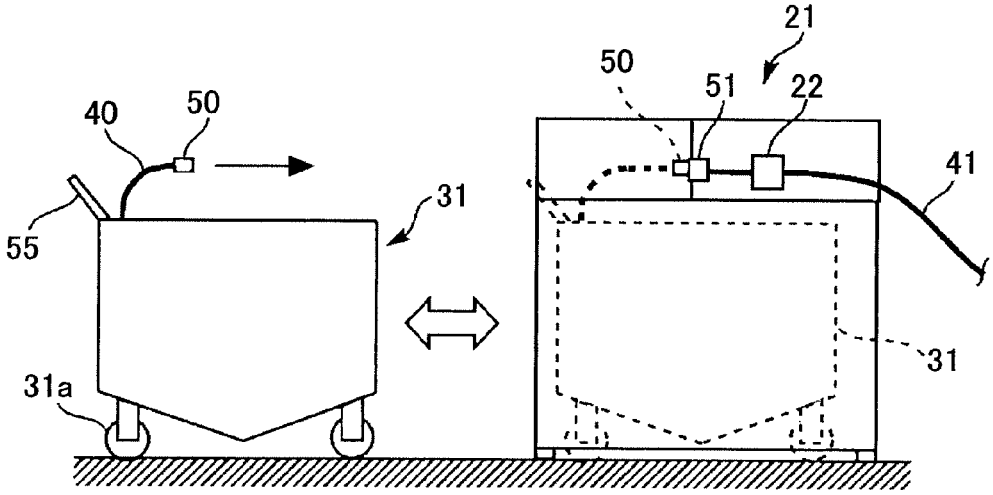
FIG. 3 is a diagram illustrating where a particle accommodating unit is detached from the particle supply apparatus according to the first embodiment.
Figure 4:
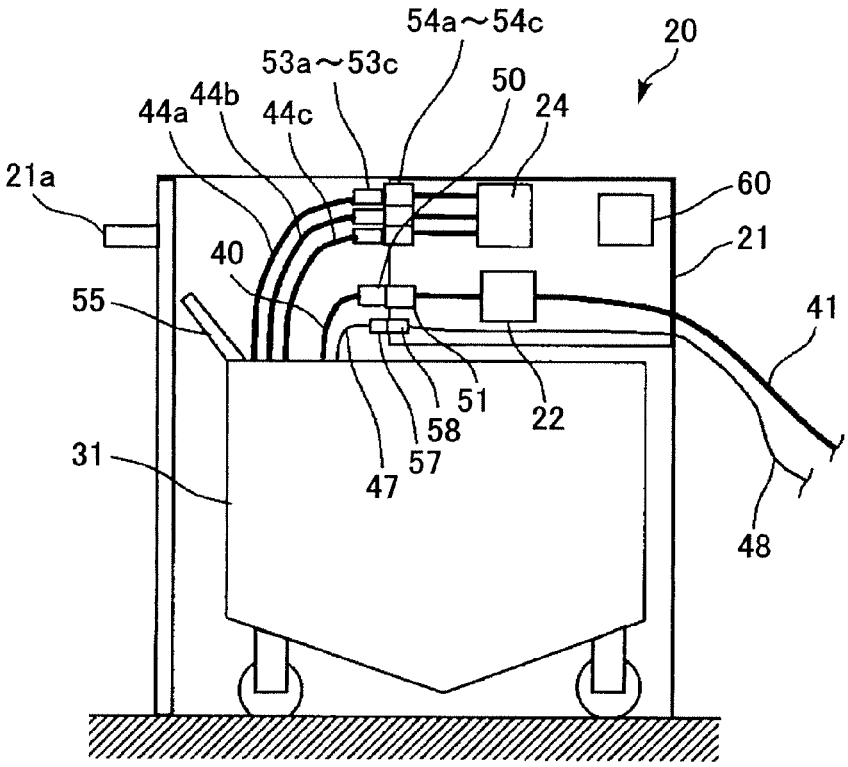
FIG. 4 is a diagram showing a detailed configuration of the particle supply apparatus according to the first embodiment.
Figure 5:
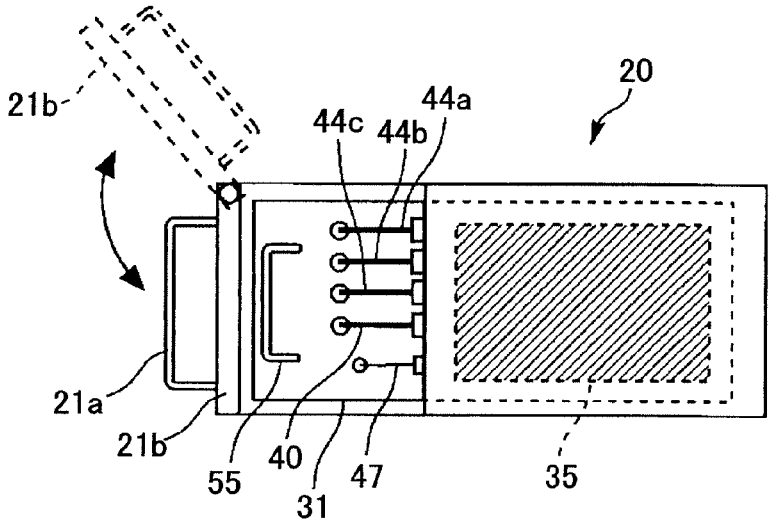
FIG. 5 is a top view of the particle supply apparatus according to the first embodiment.
Figure 6:
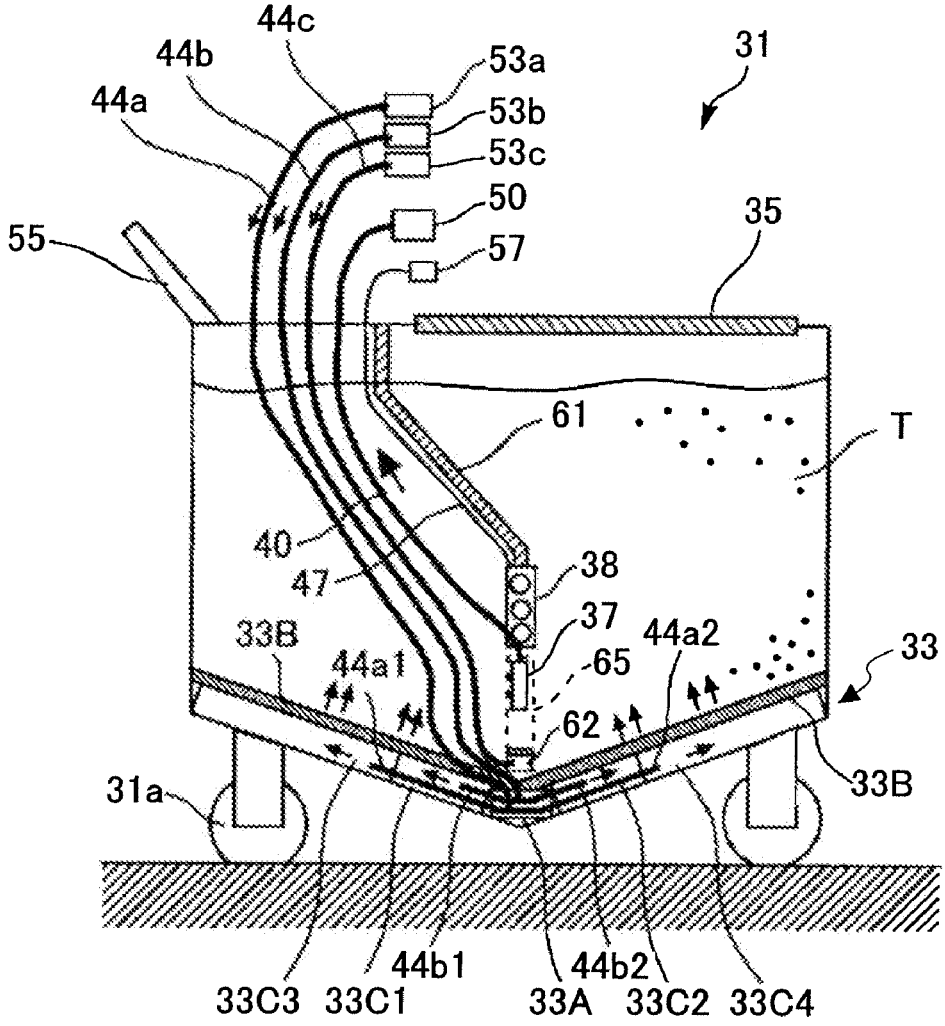
FIG. 6 is a diagram showing a configuration of the particle accommodating unit of the particle supply apparatus according to the first embodiment.

FIG. 3 is a diagram illustrating the particle accommodating unit being detached from the particle supply apparatus. FIG. 4 is a diagram showing a configuration of the particle supply apparatus. FIG. 5 is a top view of the particle supply apparatus. FIG. 6 is a diagram showing a configuration of the particle accommodating unit of the particle supply apparatus.

As is shown in FIGS. 2-5, the particle supply apparatus (toner supply unit) 20 includes a particle supply apparatus main frame (fixed unit) 21 that is fixed to the imaging apparatus (paper feed bank 2) and the particle accommodating unit (toner tank unit) 31 that accommodates toner (particles).

As is shown in FIG. 3, the particle accommodating unit 31 is configured to be detachable from the particle supply apparatus main frame 21. Specifically, the particle accommodating unit 31 has casters 31*a* arranged at its bottom side and a gripper 55 arranged at its upper side. Thus, an operator such as a user or a serviceperson may grip the gripper 55 and move the particle accommodating unit 31 in/out of the particle supply main frame 21 in the directions indicated by the arrow shown in FIG. 3 using the casters 31*a*. The particle supply apparatus main frame 21 includes a door 21*b* having a handle 21*a* (see FIG. 5). The door 21*b* may be opened/closed to install/detach the particle accommodating unit 31 into/from the particle supply apparatus main frame 21. In this case, connection members 50, 53*a*-53*c*, and 57 of the particle accommodating unit 31 are connected/detached to/from connection members 51, 54*a*-54*c*, and 58 of the particle supply apparatus main frame 21 (see FIG. 4).

According to the present embodiment, the casters 31*a* are arranged close to the uppermost edge portions of a V-shaped sloping bottom surface of the particle accommodating unit 31 so that the height of the particle accommodating unit 31 including the casters 31*a* may be relatively low.

In the particle supply apparatus 20 according to the present embodiment, the particle accommodating unit 31 may be moved and detached from the particle supply apparatus main frame 21 so that when the particle accommodating unit 31 becomes nearly empty, it may be replaced by another particle accommodating unit 31 that has ample toner accommodated therein. In this way, toner may be continually supplied to the imaging apparatus main frame 1. Also, it is noted that the particle supply apparatus 20 has a separate power supply unit 60 that is different from the power supply unit for the imaging apparatus main frame 1 so that operations for replacing the particle accommodating unit 31 may be performed without having to turn off the power of the imaging apparatus main frame 1. In other words, the replacement operations may be performed without causing downtime of the imaging apparatus main frame 1.

As is shown in FIG. 4, the particle supply apparatus main frame 21 includes a pump (conveying mechanism) 22 that introduces the toner T accommodated in the particle accommodating unit 31 by suction force and discharges the toner toward a supply destination (toner hopper 9), an air pump 24 that supplies air to a gas spouting unit (fluidized bed) 33 (see FIG. 6) of the particle accommodating unit 31, and the power supply unit 60, for example. In one preferred embodiment, a diaphragm air pump may be used as the pump 22.

It is noted that in the present embodiment, the toner hopper 9 of the imaging apparatus main frame 1 corresponds to the supply destination for the toner supplied from the particle supply apparatus 20; however, in an alternative embodiment, the toner replenishing unit 5*a* of the developing unit 5 may be the supply destination for the toner supplied from the particle supply apparatus 20, for example.

As is shown in FIG. 6, the particle accommodating unit 31 includes a suction pipe 37; the gas spouting unit 33; four tubes 40 and 44*a*-44*c* made of flexible silicon rubber; a second gas spouting unit 62, a holding member 65 that holds the second gas spouting unit 62 and the suction pipe 37, a remaining toner sensor (near end sensor) 38 as a detection unit for detecting the amount of toner remaining in the particle accommodating unit 31; a cable (harness line) 47 electrically connected to the remaining toner sensor 38; and a support member 61 that supports the remaining toner sensor 38, the holding member 65, and the cable 47, for example. Also, the particle accommodating unit 31 accommodates toner T having a volume average particle diameter within a range of 3-15 μm. The horizontal cross section of the particle accommodating unit 31 is arranged into a rectangular shape to secure adequate capacity for accommodating the toner T.

The bottom surface of the particle accommodating unit 31 is arranged into a sloped surface with a center portion arranged at a lowermost position. In other words, the bottom surface of the particle accommodating unit 31 is arranged into a V-shaped sloping surface. The gas spouting unit (fluidized bed) 33 is arranged along the sloping bottom surface of the particle accommodating unit 31.

It is noted that the sloping angle of the sloping bottom surface of the particle accommodating unit 31 is arranged to be smaller than the angle of repose for the toner T accommodated within the particle accommodating unit 31. Specifically, for example, while the angle of repose for the toner T may be approximately 40 degrees, the sloping angle of the sloping surface may be approximately 20 degrees. By arranging the sloping angle of the sloping surface to be relatively small, a dead space created as a result of sloping may be reduced and the toner may be prevented from piling up at a lowermost region (region around the lowermost position) of the sloping surface to excessively increase the bulk density at this region.

The gas spouting unit 33 includes an intermediate unit 33A, a porous member 33B, and four chambers 33C1-33C4, for example, and is configured to spout air (gas) into the particle accommodating unit 31. The lateral cross section (i.e., cross section orthogonal to the air spouting direction) of the gas spouting unit 33 is arranged into a substantially rectangular shape.

The porous member 33B of the gas spouting unit 33 has holes with diameters that are arranged to be smaller than the particle size (diameter) of toner T, and is arranged at a side that comes into direct contact with the toner T accommodated within the particle accommodating unit 31. Air discharged from the air pump 24 of the particle supply apparatus main frame 21 is supplied to the porous member 33B via the tubes 44*a*, 44*b*, and the chambers 33C1-33C4, and the porous member 33B acts as the air spouting outlet for spouting air into the particle accommodating unit 31.

It is noted that the porous member 33B is made of a porous material having fine holes for passing air. The porous member 33B is configured to have an aperture ratio of 5-40% (preferably within 10-20%) and an average aperture diameter of 0.3-20 μm (preferably within 5-15 μm), and the average hole diameter of its holes is arranged to be 0.1-5 times (preferably 0.5-3 times) the volume average particle diameter of the toner T.

The porous member 33B may be made of glass, sintered resin particles, photo-etched resin, thermally perforated resin or some other type of porous resin material, sintered metal, a perforated metal plate material, a mesh laminate, or a metal material having selectively fused holes that may be obtained by causing precipitation of metal copper around fusible metal threads through electrochemical processing to fabricate a copper plate with the fusible metal threads implanted therein and selectively removing the fusible metal threads implanted into the copper plate, for example.

By spouting air toward the toner T accommodated in the particle accommodating unit 31 via the porous member 33B as is described above, the bulk density of the toner may be reduced, the toner T may be fluidized, and cross-linking of the toner T may be prevented, for example. It is noted that since each toner particle weighs relatively little and a relatively strong air pressure is applied to the porous member 33B, it is unlikely for a toner particle to penetrate the chambers 33C1-33C4 or clog up the porous member 33B even when the toner particle enters a hole of the porous member 33B.

As is shown in FIG. 6, four independent chambers 33C1-33C4 are arranged below the porous member 33B.

Specifically, the first chamber 33C1 and the second chamber 33C2 are adjacent to the intermediate unit 33A that is arranged at the lowermost region of the sloping bottom surface. The first chamber 33C1 receives air from the air pump 24 that is conveyed through the connection members 53*b*, 54*b*, and the tube (second tube) 44*b* and diverged by the intermediate unit 33A via a discharge outlet 44*b*1. The second chamber 33C2 receives air from the air pump 24 that is conveyed through the connection members 53*b*, 54*b* and the second tube 44*b* and diverged by the intermediate unit 33A via a discharge outlet 44*b*2. The air supplied to the first chamber 33C1 and the second chamber 33C2 is spouted at the lowermost region of the sloping surface of the particle accommodating unit 31 via the porous member 33B.

The third chamber 33C3 and the fourth chamber 33C4 are adjacent to the first chamber 33C1 and the second chamber 33C2, respectively. The third chamber 33C3 receives air from the air pump 24 that is conveyed via the connection members 53*a*, 54*a*, and the tube (first tube) 44*a* and diverged by the intermediate unit 33A via a discharge outlet 44*a*1. The fourth chamber 33C4 receives air from the air pump 24 that is conveyed via the connection members 53*a*, 54*a*, and the first tube 44*a* and diverged by the intermediate unit 33A via a discharge outlet 44*a*2. The air supplied to the third chamber 33C3 and the fourth chamber 33C4 is spouted at regions of the sloping bottom surface other than the lowermost region via the porous member 33B.

It is noted that the area (i.e. area of contact surface that is in contact with the porous member 33B) or the volume of the first chamber 33C1 and the second chamber 33C2 is arranged to be smaller than the area or volume of the third chamber 33C3 and the fourth chamber 33C4.

By arranging the gas spouting unit 33 to have the above-described configuration, the gas spouting amount per unit area per unit time at the lowermost region of the sloping surface (where the first chamber 33C1 and the second chamber 33C2 are arranged) may be greater than the gas spouting amount per unit area per unit time at other regions of the sloping surface (where the third chamber 33C3 and the fourth chamber 33C4 are arranged). It is noted that the toner at the lowermost region of the sloping surface tends to have a higher bulk density compared to the rest of the regions of the sloping surface. Thus, by varying the gas spouting amount of the gas spouting unit 33 for the different positions on the sloping surface, uniform fluidity of the toner may be achieved throughout the sloping surface in an efficient manner, for example.

As can be appreciated from the above descriptions, according to the present embodiment, plural chambers (e.g., first through fourth chambers 33C1-33C4) are provided at the gas spouting unit 33, and air from the air pump 24 is individually supplied to the different chambers so that the gas spouting amount may be varied for the different positions on the sloping surface. In the present embodiment, the difference in the gas spouting amount is created by varying the size of the chambers (area or volume of the chambers 33C1-33C4) from which air is spouted.

However, it is noted that measures for varying the gas spouting amount is not limited to the above-described embodiment, and other measures may be implemented such as arranging different porous members (e.g., having different hole diameters and/or hole densities) at different positions of the sloping surface, or varying the air pressure of air discharged from the air pump 24.

In a preferred embodiment, the gas spouting amount per unit area per unit time at the lowermost region of the sloping surface (where the first chamber 33C1 and the second chamber 33C2 are arranged) is adjusted to be 1.1-2 times greater than the spouting amount per unit area per unit time at the other regions of the sloping surface (where the third chamber 33C3 and the fourth chamber 33C4 are arranged) in order to achieve advantageous effects as described above such as reduced toner bulk density and uniform toner fluidity, for example.

It is noted that the suction pipe 37 is arranged above the intermediate unit 33A (the lowermost position of the sloping surface) so that the toner T may be efficiently introduced into the suction pipe 37 even when the amount of toner T remaining in the particle accommodating unit 31 becomes small. The suction pipe 37 is connected to one end of the pump 22 via the suction tube 40, and the connection members (intermediate pipes) 50 and 51. The other end of the pump 22 is connected to the toner hopper 9 of the imaging apparatus main frame 1 via a discharge tube (conveying mechanism) 41. According to the present embodiment, the suction pipe 37, the suction tube 40, and the connection members 50 and 51 form a particle suction path from the particle accommodating unit 31 to the pump 22, and the discharge tube 41 forms a particle discharge path from the pump 22 to the toner hopper 9. When the pump 22 is activated, the toner T within the particle accommodating unit 31 is introduced into the suction pipe 37 via a suction port 37*a* and is conveyed to the toner hopper (supply destination) via the pump 22.

In a preferred embodiment, the suction tube 40 and the discharge tube 41 are made of silicon rubber that has low toner affinity so that the toner T may be prevented from bonding with the tube to degrade toner transferability, for example.

In another preferred embodiment, at least a part of the particle suction path and the particle discharge path is made of a flexible tube (e.g. tubes 40 and 41) in order to allow flexibility in the layout of the particle accommodating unit 31, the pump 22, and the toner hopper 9.

As is shown in FIG. 2, the pump 22 is positioned above the toner hopper 9 corresponding to the toner supply destination. Accordingly, the toner T that is introduced into the pump 22 is discharged to the toner hopper 9 that is positioned lower than the pump 22. With such an arrangement, toner may be accurately conveyed with a relatively small discharge force owing to the positional level difference between the pump 22 and the toner hopper 9 even when the distance from the pump 22 to the toner hopper 9 is relatively long, for example.

In a preferred embodiment, the slope angle θ of the particle discharge path formed by the discharge tube 41 may be within 20-90 degrees (more preferably within 25-45 degrees). In this way, toner may be efficiently conveyed through the particle discharge path by the discharge force of the pump 22 as well as the gravitational falling force created by the slope angle.

Also, according to the present embodiment, the suction port 37*a* (suction pipe 37) of the particle suction path is positioned lower than the pump 22. Specifically, the toner T within the particle accommodating unit 31 is introduced into the suction pipe 37 (e.g., having an internal diameter of approximately 6-8 mm) positioned at the lowermost region of the particle accommodating unit 31 and conveyed upward by suction force. In a preferred embodiment, the distance between the pump 22 and the suction pipe 37 is arranged to be shorter than the distance between the pump 22 and the toner hopper 9 in order to reduce the suction force of the pump 22 required for conveying the toner T upward against the gravitational force so that the toner T within the particle accommodating unit 31 may be efficiently conveyed by suction force. Also, since the toner T is directed upward in the particle suction path, the toner T may be prevented from scattering in large amounts when the suction tube 40 is damaged or detached; that is, the scattered toner may be limited to that flowing within the suction tube 40, for example.

According to the present embodiment, the vertical distance H1 between the suction port 37*a* of the suction pipe 37 and the pump 22 is arranged to be 1.5-2 times the vertical distance H2 between the toner hopper 9 and the pump 22 (see FIG. 2). In this way, overall balance may be maintained in the conveying path for conveying toner from the suction port 37*a* of the suction pipe 37 to the toner hopper 9 via the pump 22.

Also, according to the present embodiment, the pump 22 (particle supply apparatus main frame 21) and the particle accommodating unit 31 are arranged outside the imaging apparatus main frame 1 so that the configuration of the particle supply apparatus 20 may not be restricted by the configuration of the imaging apparatus main frame 1. For example, the pump 22 may be arranged at a desired position regardless of the height of the imaging apparatus main frame 1. In another example, the imaging apparatus main frame 1 may be stationed within an office space whereas the particle supply apparatus 20, which is prone to cause tainting by toner, may be stationed outside the office space.

Figure 7:
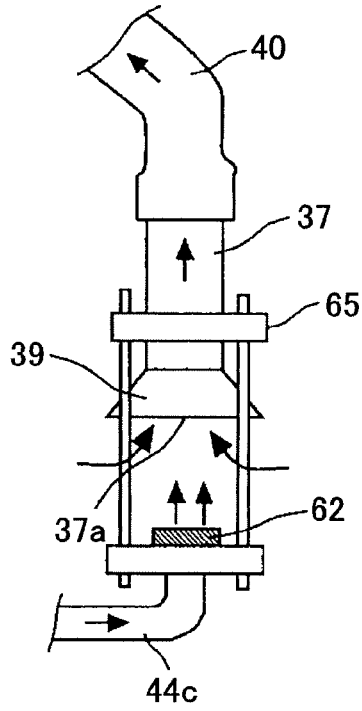
FIG. 7 is an enlarged partial view of an area surrounding a suction tube.

FIG. 7 is a diagram illustrating in detail the suction pipe 37 and elements associated therewith. As is shown in this drawing, the suction pipe 37 is fixed to the holding member 65 that is supported by the support 61 (see FIG. 6). The second gas spouting unit 62 held by the holding member 65 is arranged below the suction pipe 37. The holding member 65 (and support 61) is configured to fix the position of the suction pipe 37 within the particle accommodating unit 31 and the position of the second gas spouting unit 62 with respect to the suction pipe 37.

The second gas spouting unit 62 spouts air from the air pump 24 that is conveyed via the connection members 53*c*, 54*c*, and the tube (third tube) 44*c* directly toward the suction port 37*a* of the suction pipe 37 (and the remaining toner sensor 38 shown in FIG. 6), and is made of a porous material. In one embodiment, the second gas spouting unit 62 may include one or more chambers. The porous material of the second gas spouting unit 62 is identical to the material used for the porous material 33B of the gas spouting unit 33. In this way, the bulk density of the toner T around the suction port 37*a* of the suction pipe 37 may be reduced and the toner may be fluidized so that clogging of the conveying mechanism 22, 37, 40, and 41 may be prevented and toner transferability may be improved, for example. Also, the toner T around the remaining toner sensor 38 may be fluidized so that detection performance of the remaining toner sensor 38 may be stabilized, for example.

It is noted that in the present embodiment, the second gas spouting unit 62 is used to spout air toward the suction port 37*a* of the suction pipe 37 and the remaining toner sensor 38; however, the present invention is not limited to such an embodiment and for example, a gas spouting unit for spouting air toward the region close to the suction port 37*a* of the suction pipe 37 and a gas spouting unit for spouting air toward the region close to the remaining toner sensor 38 may be separately provided. In another alternative embodiment, the second gas spouting unit 62 and the gas spouting unit 33 arranged at the bottom of the particle accommodating unit 31 may be combined to form one gas spouting unit, for example.

Also, as is shown in FIG. 7, in the present embodiment, a rectifying member 39 is provided at the suction port 37*a* of the suction pipe 37. The rectifying member 39 is a funnel-shaped member that enlarges the opening area of the suction port 37*a* to increase the suction force of the suction port 37*a*.

Figure 8:
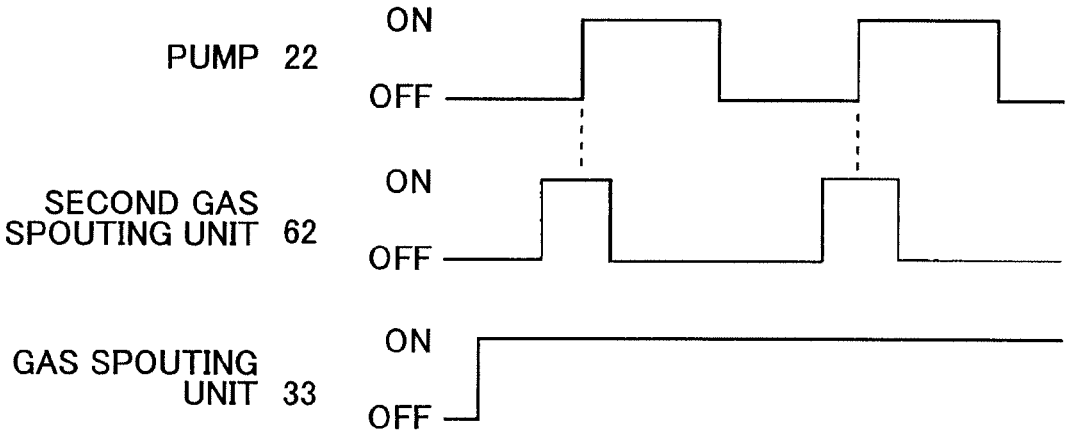
FIG. 8 is a timing chart illustrating control operations for controlling a second gas spouting unit.

FIG. 8 is a timing chart illustrating operations of the particle supply apparatus 20 according to the present embodiment. As is shown in this drawing, before suction operations of the pump 22 (fluid suction via the suction pipe 37) are started, operations of the second gas spouting unit 62 for spouting air toward the suction port 37*a* are started. In this way, fluidization of toner may be ensured at the time toner is introduced into the suction pipe 37 so that toner transfer may be smoothly performed by the conveying mechanism 22, 37, 40, and 41.

Also, the operations of the second gas spouting unit 62 for spouting air toward the suction port 37*a* are ended before the suction operations by the pump 22 (fluid suction via the suction pipe 37) are ended. Specifically, once the fluidity of toner is induced by the second gas spouting unit 62 right before toner suction operations via the suction pipe 37 are started, the toner transfer operations may be smoothly performed by the conveying mechanism 22, 37, 40, and 41 without continuing the operations of the second gas spouting unit 62. Accordingly, in the present embodiment, the operations of the second gas spouting unit 62 are terminated after a predetermined time elapses from the time operations of the pump 22 are started in order to reduce the duty time of the second gas spouting unit 62.

It is noted that in the present embodiment, the operations of the gas spouting unit 33 (33A, 33B, 33C1-33C4) are performed independent of the operations of the second gas spouting unit 62. The operations of the gas spouting unit 33 may be continually performed, intermittently performed, or performed according to the decrease in fluidity of the toner within the particle accommodating unit 31 (e.g., at predetermined time intervals), for example. In one embodiment, the timing for supplying air to the first chamber 33C1 and the second chamber 33C2 and the timing for supplying air to the third chamber 33C3 and the fourth chamber 33C4 may be varied in order to obtain uniform fluidity of the toner within the particle accommodating unit 31 in an efficient manner, for example.

In another embodiment, operations of the second gas spouting unit 62 may be intermittently performed while the pump 22 is in operation so that toner transferability may be improved when the pump 22 is continually operated for a long period of time, for example.

In another embodiment, operations of the second gas spouting unit 62 may be intermittently performed in a case where the pump 22 is not operated (abandoned) for a long period of time so that toner transfer operations may be smoothly performed in response to activation of the pump 22 even after the pump has been abandoned for a long period of time, for example.

In another embodiment, the second gas spouting unit 62 may be forcefully operated for a predetermined period of time when the main switch of the imaging apparatus main frame 1 is turned on. In this way, warm up operations may be performed in the particle supply apparatus 20 when warm up operations are performed in the imaging apparatus main frame 1 and smooth toner transfer operations may be immediately performed in response to activation of the second gas spouting unit 62, for example.

It is noted that in the present embodiment, three tubes 44*a*-44*c* are used to separately supply air to the third chamber 33C3 and fourth chamber 33C4, the first chamber 33C1 and second chamber 33C2, and the second gas spouting unit 62, respectively. In this way, air flow and air pressure may be easily adjusted according to the characteristics of the different air supply destinations, for example.

Referring to FIGS. 5 and 6, the particle accommodating unit 31 has an opening and a filter (evacuation member) 35 that covers that opening at its upper face. The filter 35 prevents the toner T within the particle accommodating unit 31 from leaking outside and prevents the internal pressure of the particle accommodating unit 31 from increasing. The filter 35 may be made of a material that is identical to that used for the porous member 33B, or some other material such as GORE-TEX (registered trademark of Japan Gore-Tex, Inc.) corresponding to a porous fluorine resin material. It is noted that the filter 35 may be positioned at any position above the toner load line of the particle accommodating unit 31 formed when the toner is full. For example, the filter 35 does not necessarily have to be provided at the upper face of the particle accommodating unit 31 and may alternatively be arranged at a side face of the particle accommodating unit 31.

Figure 9:
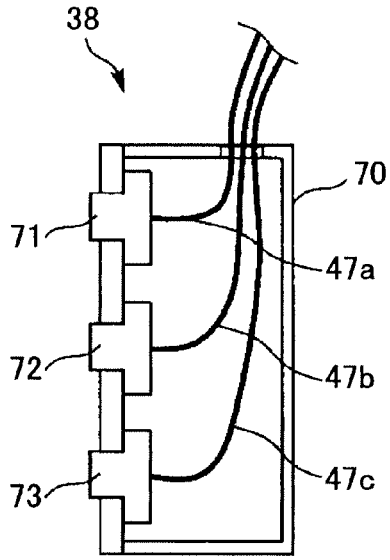
FIG. 9 is a cross-sectional view of a remaining toner sensor.

FIG. 9 is a diagram showing a detailed configuration of the remaining toner sensor 38. As is shown in this drawing, the remaining toner sensor 38 includes three piezoelectric sensors 71-73 that are aligned in a vertical direction. The three piezoelectric sensors 71-73 are held by a case 70 that is supported by the support 61. The three piezoelectric sensors 71-73 are electrically connected to cables 47*a*-47*c*, respectively, and the cables 47*a*-47*c* are bound together within the case 70 to form a bundled cable 47 that is supported by the support 61 and electrically connected to a control unit of the imaging apparatus main frame 1 via the connection members 57, 58, and a cable 48 (see FIG. 4).

In the present embodiment, the remaining toner sensor 38 is configured to inform a user of the remaining amount of toner within the particle accommodating unit 31 by measuring the remaining amount of toner on a scale of three different levels.

Specifically, when the uppermost piezoelectric sensor 71 of the remaining toner sensor 38 detects that there is no toner at its corresponding position (height), a message indicating that the remaining amount of toner within the particle accommodating unit 31 is decreasing may be displayed at a display unit of the imaging apparatus main frame 1 ("PRE NEAR END" display). Then, when the middle piezoelectric sensor 72 of the remaining toner sensor 38 detects that there is no toner at its corresponding position (height), a message indicating that the toner within the particle accommodating unit 31 is almost gone may be displayed at the display unit of the imaging apparatus main frame 1 ("NEAR END" display). Then, when the lowermost piezoelectric sensor 73 of the remaining toner sensor 38 detects that there is no toner at its corresponding position (height), a message indicating that there is not toner remaining in the particle accommodating unit 31 may be displayed at the display unit of the imaging apparatus main frame 1 ("TONER END" display) and suction operations of the pump 22 may be stopped until replacement operations for replacing the particle accommodating unit 31 are completed, for example.

It is noted that the remaining toner sensor 38 is provided outside the suction pipe 37 in the present embodiment so that toner clumps may be prevented from being generated within the suction pipe 37.

Also, the remaining toner sensor 38 is positioned above the suction port 37*a* of the suction pipe 37 in the present embodiment so that cases in which only air is introduced into the suction pipe 37 may be prevented. Specifically, the remaining toner sensor 38 may be used to send a signal to stop toner suction operations by the pump 22 while the toner is still at a position (level) above the suction port 37*a*. In this way, the suction pipe 37 may be prevented from merely introducing air by suction when the toner is already gone (or when the mixing rate of toner with respect to air is low).

Also, the remaining toner sensor 38 is positioned above the gas spouting unit 33 so that the remaining toner detection accuracy of the remaining toner sensor 38 may be improved, for example. Specifically, by arranging the gas spouting unit 33 to fluidize the toner, the toner remaining amount may be stably and accurately detected, for example.

Also, the remaining toner sensor 38 is positioned above the lowermost position of the sloping surface of the gas spouting unit 33 so that the remaining toner sensor may accurately detect the remaining amount of toner within the particle accommodating unit 31 being introduced into the suction tube 37 that is also positioned above the lowermost position to enable efficient and economical transfer of the toner.

As can be appreciated from the above descriptions, according to the present embodiment, air is spouted from the bottom of the particle accommodating unit 31 by the gas spouting unit 33 while the toner T within the accommodating unit 31 is introduced into the suction pipe 37 to be conveyed to the toner hopper 9 corresponding to the supply destination. In this way, the toner accommodating capacity may be increased without causing damage to the toner T or requiring complicated replacement procedures, fine adjustment of the toner supply amount may be performed, and the toner T may be efficiently and accurately transferred to the toner hopper 9 without causing the toner T to scatter, for example.

It is noted that in the present embodiment, the air pump 24 for supplying air to the gas spouting unit 33 and the second gas spouting unit 62 is positioned above the particle accommodating unit 31 of the particle supply apparatus main frame 21; however, the present invention is not limited to such an embodiment, and the air pump 24 may alternatively be positioned below the sloping surface of the particle accommodating unit 31, for example. In such a case, the length of the air conveying path for conveying air to the gas spouting unit 33 and the second gas spouting unit 62 may be reduced so that a pipe may be used instead of a (flexible) tube for forming the air conveying path, for example.

Also, in the present embodiment, the particle supply apparatus main frame 21 is arranged outside the imaging apparatus main frame 1; however, the particle supply apparatus main frame 21 may alternatively be arranged inside the imaging apparatus main frame 1. For example, the pump 22, the air pump 24, and the power supply unit 60 may be arranged inside the imaging apparatus main frame 1, and the particle accommodating unit 31 may be configured to be detachable with respect to the imaging apparatus main frame 1.

Second Embodiment

In the following, a second embodiment of the present invention is described with reference to FIGS. 10-13.

Figure 10:
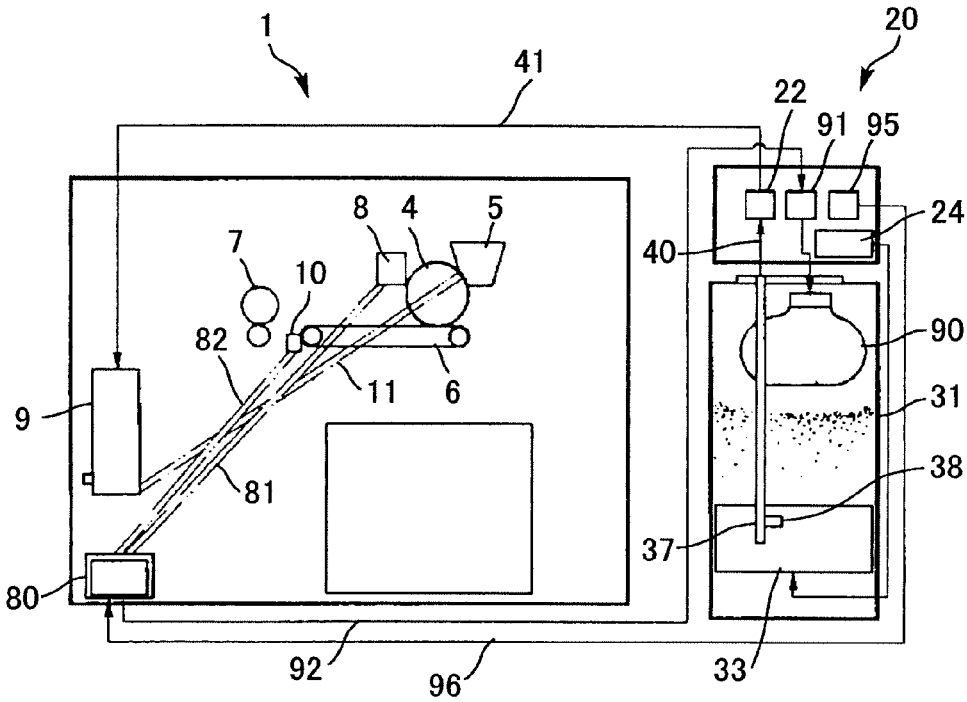
FIG. 10 is a diagram showing configurations of an imaging apparatus main frame and a particle supply apparatus according to a second embodiment of the present invention.
Figure 11:
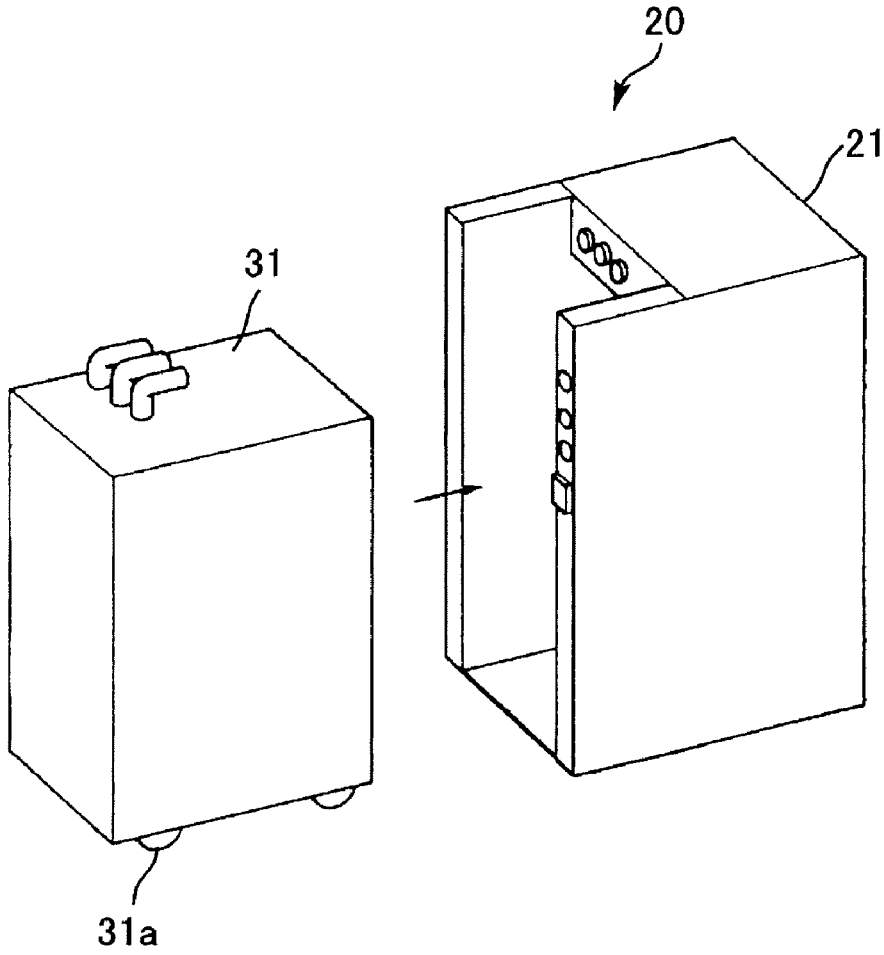
FIG. 11 is a diagram illustrating where a particle accommodating unit is detached from the particle supply apparatus according to the second embodiment.
Figure 12:
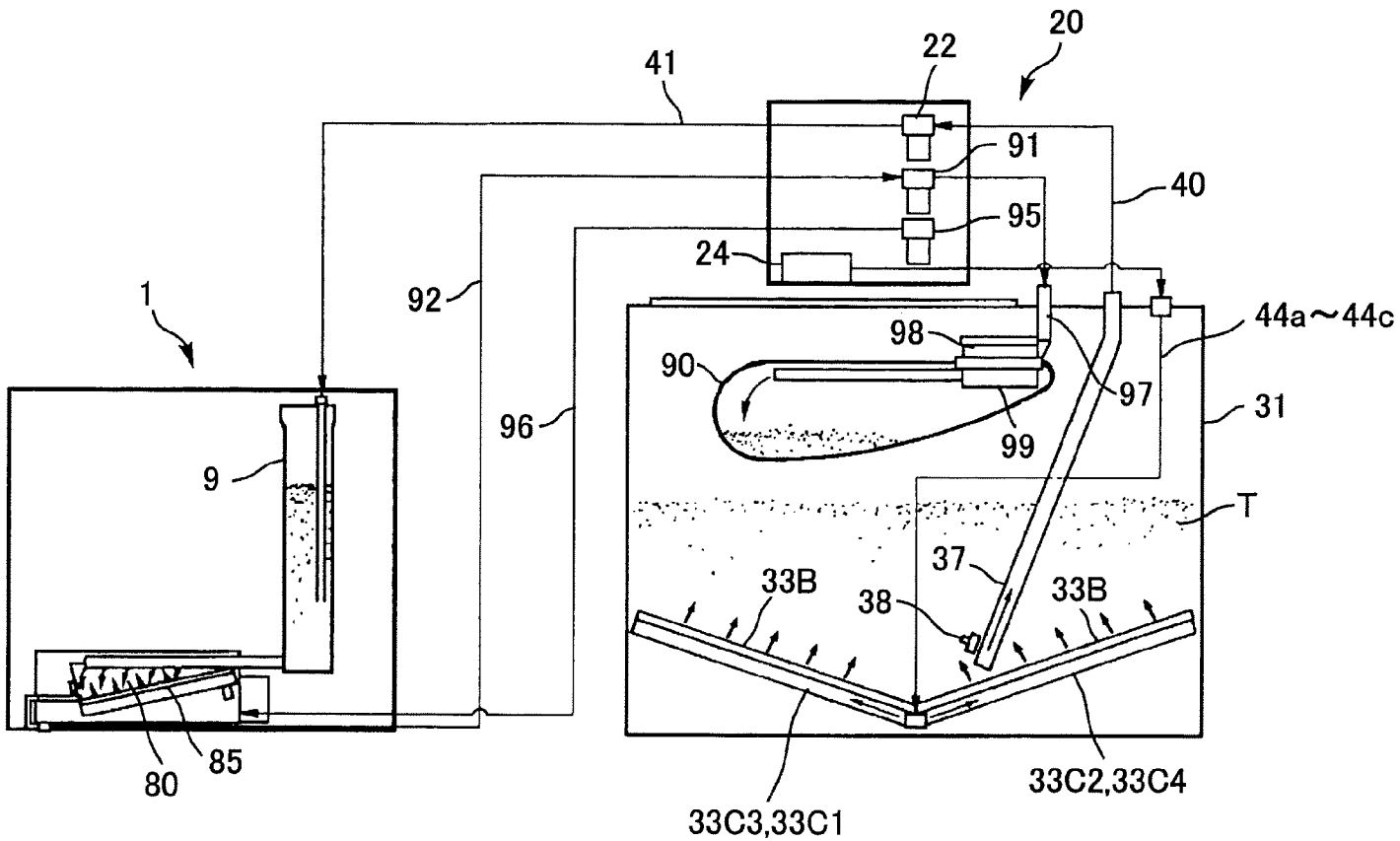
FIG. 12 is a diagram showing detailed configurations of the particle supply apparatus and the imaging apparatus main frame according to the second embodiment.
Figure 13:
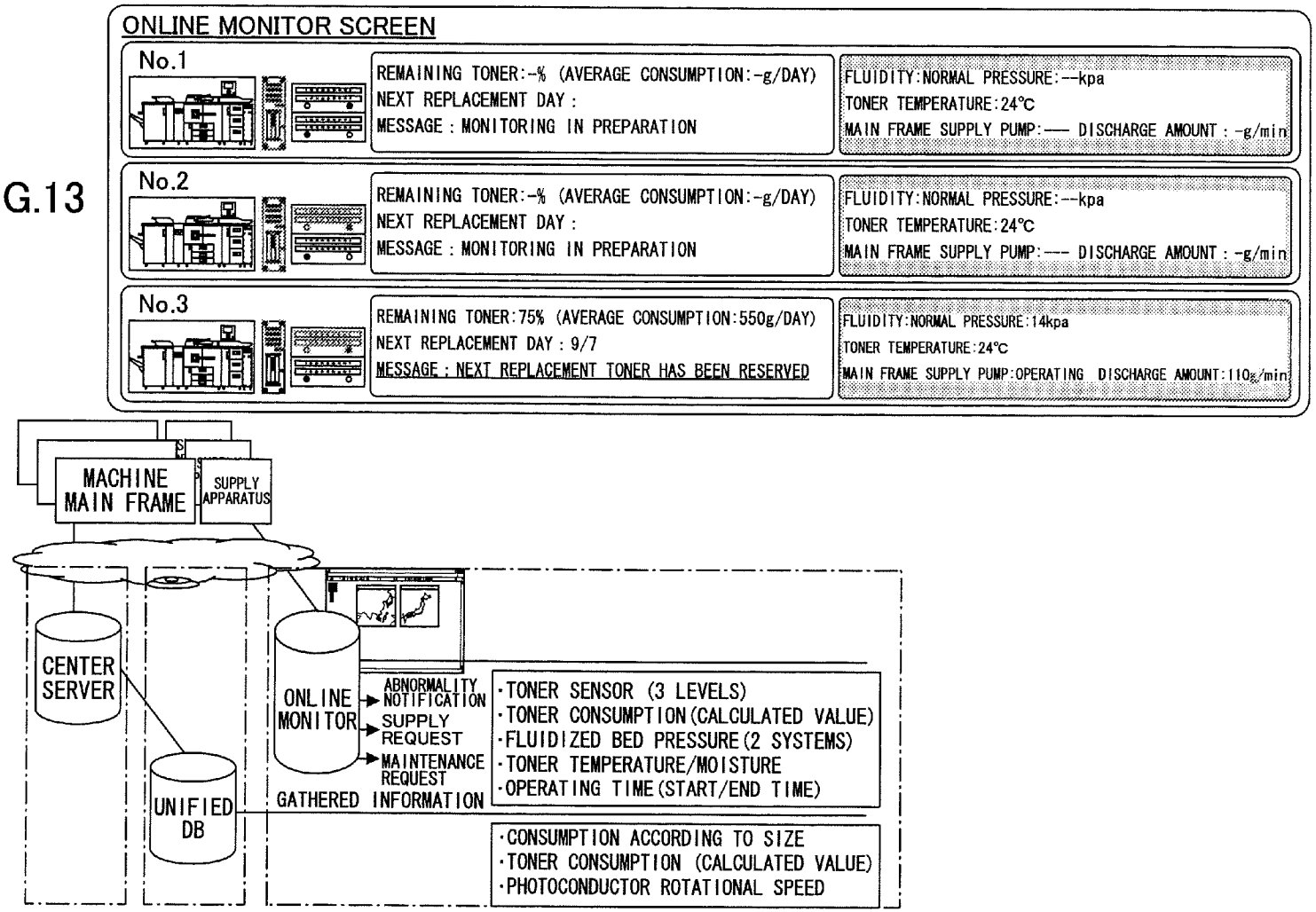
FIG. 13 is a diagram illustrating a monitoring system according to the second embodiment.

FIG. 10 is a diagram illustrating overall configurations of an imaging apparatus main frame and a particle supply apparatus according to the second embodiment. FIG. 11 is a perspective view of a particle accommodating unit being detached from the particle supply apparatus. FIG. 12 is a diagram illustrating detailed configurations of the imaging apparatus main frame and the particle supply apparatus according to the present embodiment. FIG. 13 is a diagram illustrating a monitoring system for monitoring the imaging apparatus according to the present embodiment.

It is noted that the imaging apparatus according to the second embodiment has a configuration similar to that of the imaging apparatus according to the first embodiment and identical components are given the same reference numerals. However, the imaging apparatus according to the second embodiment differs from that of the first embodiment in that it includes a collection container 90 for accumulating disposal toner within the particle accommodating unit 31 and is connected to a monitoring system via a LAN.

Referring the FIG. 10, the imaging apparatus according to the second embodiment includes an imaging apparatus main frame 1 and a particle supply apparatus 20 as with the imaging apparatus according to the first embodiment.

The imaging apparatus according to the second embodiment differs from that of the first embodiment in that untransferred toner that is collected by a cleaning unit 8 is accumulated in the collection container 90 as disposal toner. Specifically, untransferred toner that is collected by the cleaning unit 8 is conveyed to the collection container 90 by second conveying mechanism 81, 80, 92, and 91. Also, a transfer unit according to the second embodiment includes a transfer belt 6 and a belt cleaner 10 that collects toner attached to the transfer belt 6, and the toner collected by the belt cleaner 10 may also be conveyed by the second conveying mechanism 81, 80, 92, and 91 to be accumulated in the collection container 90.

It is noted that in a conventional imaging apparatus, a collection container for accumulating untransferred toner collected by a cleaning unit as disposal toner is arranged inside the imaging apparatus main frame, and when the collection container becomes full, operations of the imaging apparatus main frame have to be stopped in order to replace the collection container with a new collection container.

In the second embodiment, the particle accommodating unit 31 may accommodate approximately 30-40 kg of toner, for example. In a case where the transfer rate of toner in toner image transfer operations is approximately 90%, 10% (i.e., 3-4 kg) of the toner accommodated in the particle accommodating unit 31 may be collected by the cleaning unit 8 and the belt cleaner 10 as untransferred toner (disposal toner).

It is noted that if a given user consumes approximately 30 kg of toner per month and the transfer rate of toner is approximately 90%, even when a collection container with a relatively large capacity of approximately 10 kg is provided, onerous replacement operations for replacing the collection container may have to be performed once in every 2-3 months in the conventional imaging apparatus, for example. In this respect, measures for enlarging the collection container may be contemplated to reduce the number of times the replacement operations have to be performed. However, it is rather difficult to implement such measures in the conventional imaging apparatus where the collection container is arranged inside the imaging apparatus main frame.

According to the second embodiment, the collection container 90 is arranged inside the particle accommodating unit 31 of the particle supply apparatus 20, and thereby, the capacity of the collection container 90 may be increased in accordance with the increase in capacity of the particle accommodating unit 31 without having to enlarge the imaging apparatus main frame 1. Specifically, the toner collected by the cleaning unit 8 and the belt cleaner 10 of the imaging apparatus main frame 1 may be accumulated in the collection container 90 arranged inside the particle accommodating unit 31, and the collection container 90 may be replaced at the same time the particle accommodating unit 31 is replaced. It is noted that FIG. 11 illustrates the particle accommodating unit 31 being detached from the imaging apparatus main frame 21.

In the following, operations for collecting and accumulating disposal toner in the collection container 90 are described.

Referring to FIG. 10, untransferred toner collected by the cleaning unit 8 is temporarily accumulated in a collection unit 80 via a conveying path 81 (second conveying mechanism). Similarly, toner collected by the belt cleaner 10 is temporarily accumulated in the collection unit 80 via a conveying path 82 (second conveying mechanism).

As is shown in FIG. 12, a third gas spouting unit (fluidized bed) including a porous member 85 is arranged at the bottom section of the collection unit 80, and air that is conveyed from an air pump 95 of the particle supply apparatus 20 is supplied to the third gas spouting unit via a tube 96. In this way, air may be spouted from the porous member 85 so that the toner accumulated in the collection unit 80 may be fluidized and the toner may be efficiently conveyed to the collection container 90 via a tube 92 (second conveying mechanism) by the suction force of a pump 91 (second conveying mechanism).

It is noted that that size of the collection container 90 arranged inside the particle accommodating unit 31 may be adjusted to accommodate the estimated amount of toner to be collected which amount may be calculated from the amount of toner accommodated in the particle accommodating unit 31. Accordingly, the size of the collection container 90 may not be excessively large in relativity to the size of the particle accommodating unit 31. Also, since the collection container 90 is arranged within the particle accommodating unit 31, measures do not have to be implemented against external shock and the required durability of the collection container 90 may be reduced, for example.

The collection container 90 according to the second embodiment may be a flexible pouch member made of resin material such as a vinyl bag or a poly bag. The collection container 90 may be mounted to a setting unit 99 with a rubber band, for example. The setting unit 99 includes a pipe 97 with a vent that discharges the disposal toner and a filter 98 as an evacuation mechanism for discharging air introduced into the collection container 90. By arranging the pipe 97 and the filter 98 to the setting unit 99, the pipe and the filter 98 may be attached to the collection container 90 at once, for example.

It is noted that the imaging apparatus according to the second embodiment is connected to a LAN and is monitored by a monitoring system (toner management system) via a network.

FIG. 13 is a diagram illustrating the structure of such a monitoring system.

By structuring the monitoring system as is illustrated, a serviceperson may be able to monitor the use of an imaging apparatus by a given user, and determine in advance the timing for replacing a particle accommodating unit or an abnormality of the imaging apparatus, for example.

Specifically, the monitoring system includes a monitoring apparatus that monitors use of the particles in the particle supply apparatus 20. The monitoring apparatus acquires information pertaining to the remaining toner amount detected by the remaining toner sensor 38 that is arranged within the particle supply apparatus 20. The monitoring apparatus has a transmission function for transmitting information pertaining to monitoring results via a LAN.

It is noted that the monitoring results (monitoring data) obtained by the monitoring apparatus may be transmitted to various departments such as the manufacturing department, the service department, and the sales department of the manufacturer and/or service providing company of the imaging apparatus to be used for production planning, service planning, and sales planning, for example. Specifically, by determining the toner consumption rate, the timing for replacing the particle accommodating unit 31 may be predicted and the particle accommodating unit 31 (and the collection container 90) may be replaced in a timely manner before the toner runs out, for example. In this way, convenient toner end time operations and disposal toner processing operations may be enabled, for example.

It is noted that the inventors of the present invention conducted tests using the monitoring system and the imaging apparatus according to the second embodiment where the imaging apparatus includes the collection container 90 with a capacity of 3 liters arranged inside the particle supply apparatus 20 (particle accommodating unit 31) and using a conventional imaging apparatus without the particle supply apparatus 20 (and the collection container 90) as a comparison example. Specifically, the tests were conducted for one week and involved making ten thousand prints per day.

In the case of using the conventional imaging apparatus, disposal toner processing operations had to be performed on an average of once in three days and replacement operations for replacing the toner accommodating unit had to be performed frequently as well so that the downtime of the conventional imaging apparatus amounted to a total of approximately one entire day.

On the other hand, in the case of using the imaging apparatus according to the second embodiment and monitoring the imaging apparatus with the monitoring system, no downtime was created in the imaging apparatus, and replacement operations for replacing the particle accommodating unit 31 (and the collection container 90) could be performed in a timely and efficient manner.

Also, as in the case of the first embodiment, according to the second embodiment of the present invention, air is spouted from the bottom of the particle accommodating unit 31 by the gas spouting unit 33 while toner T within the particle accommodating unit 31 is introduced into the suction pipe 37 to be conveyed to the toner hopper 9 (supply destination). In this way, the accommodating capacity of the toner T may be increased without causing damage to the toner T or requiring complicated replacement operations, fine adjustment of the toner supply amount may be performed, and the toner T may be prevented from scattering to be efficiently and accurately conveyed to the toner hopper 9, for example.

Third Embodiment

In the following, a third embodiment of the present invention is described with reference to FIG. 14.

Figure 14:
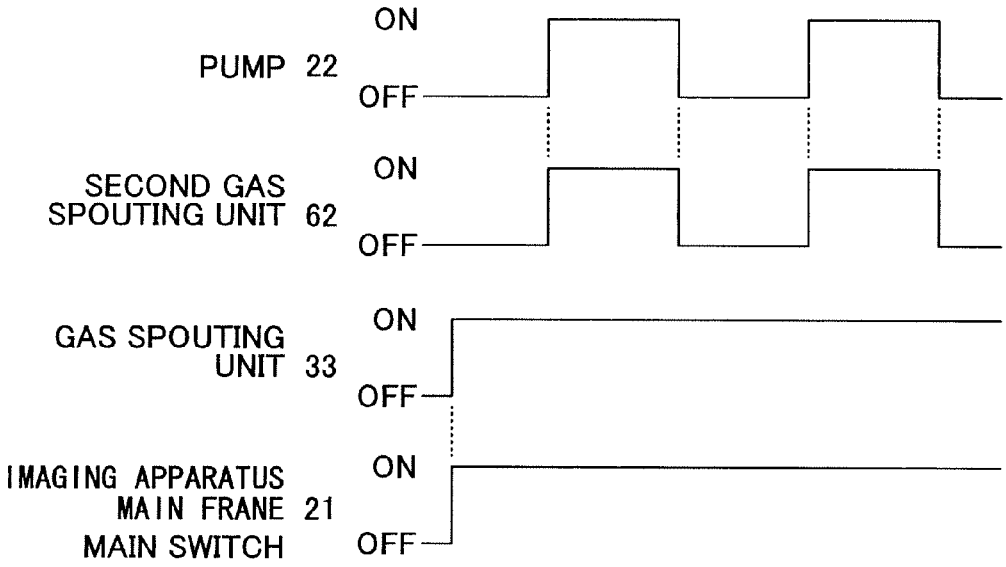
FIG. 14 is a timing chart illustrating control operations for controlling a gas spouting unit of the particle supply apparatus according to the third embodiment.

FIG. 14 is a timing chart illustrating control operations for controlling a gas spouting unit of a particle supply apparatus according to the third embodiment. It is noted that the method for controlling the gas spouting unit according to the present embodiment differs from that used in the first embodiment.

The particle supply apparatus according to the third embodiment may be similar in structure to that of the first embodiment to include a particle supply apparatus main frame 21, a pump 22 that derives toner T accommodated within a particle accommodating unit 31 and discharges the toner T to a toner hopper 9, an air pump 24 that supplies air to a gas spouting unit 33 and a second gas spouting unit 62, and a power supply unit 60, for example. Also, the particle accommodating unit 31 according to the third embodiment may be similar in structure to that of the first embodiment to include a suction pipe 37, the gas spouting unit 33, a suction tube 40, first through third tubes 44*a*-44*c*, the second gas spouting unit 62, a holding member 65, a remaining toner sensor 38, a cable 47, and a support 61, for example.

It is noted that in the third embodiment, an electromagnetic valve (not shown) is arranged within the third tube 44*c* through which air is passed from the air pump 24 toward the second gas spouting unit 62. The electromagnetic valve is used to turn on/off the operations for spouting air from the second gas spouting unit 62 toward the suction port 37*a* of the suction pipe 37. By implementing such an arrangement, operations of the gas spouting unit 33 and operations of the second gas spouting unit 62 may be performed at independent timings, for example.

As is shown in FIG. 14, according to the third embodiment, operations of the gas spouting unit 33 are started when a main power supply (not shown) of the imaging apparatus main frame 1 is turned on. Specifically, when the main power supply of the imaging apparatus main frame 1 is turned on, a drive motor of the air pump 24 is activated so that gas spouting operations of the gas spouting unit 33 may be started. More specifically, when the main power supply of the imaging apparatus main frame 1 is turned on, a signal is input to a relay of an operations circuit provided in the particle supply apparatus 20, and the drive motor of the air pump 24 is operated according to the on/off operations of the relay.

The air pump 24 may include a pump main body having an air suction valve and an evacuation valve made of Mylar (registered trademark), for example, a diaphragm made of rubber material that covers a concave portion of the pump main body, and a drive motor that changes the internal volume of the pump main body by expanding/contracting the diaphragm, for example.

By starting operations of the gas spouting unit 33 when the main power supply (main switch) of the imaging apparatus main frame 1 is turned on, the toner within the particle accommodating unit 31 may be adequately fluidized to be accurately supplied from the particle supply apparatus 20 to the toner hopper 9, for example.

When the gas spouting unit 33 is not in operation (i.e., when air is not spouted from the gas spouting unit 33), the fluidity of the toner T within the particle accommodating unit 31 may be inadequate (e.g., toner may be clogged) and the toner T may not be adequately conveyed from the particle supply apparatus 20 to the toner hopper 9. Such a problem may occur in a case where an independent switch is provided for activating the gas spouting unit 33 (air pump 24) and a user inadvertently forgets to turn on this switch, for example. In this respect, since operations of the gas spouting unit 33 are controlled to start in response to power on of the main power supply (main switch) of the imaging apparatus main frame 1 in the third embodiment, the problem described above may be prevented.

Also, according to the third embodiment, operations of the second gas spouting unit 62 are controlled in conjunction with the suction operations of the pump 22 (i.e., suction via the suction pipe 37). Specifically, operations of the second gas spouting unit are started substantially at the same time the operations of the pump 22 are started (in response to the opening of the electromagnetic valve from a closed state). Also, the operations of the second gas spouting unit 62 are ended substantially at the same time the operations of the pump 22 are ended (in response to the closing of the electromagnetic valve).

By controlling the operations of the second gas spouting unit 62 in the manner described above, air from the second gas spouting unit 62 may be prevented from being introduced into the suction pipe 37 to be conveyed to the pump 22 via the suction tube 40 when the pump 22 is not in operation, for example. Specifically, if the second gas spouting unit 62 is operated on a continual basis, air spouted from the gas spouting unit 62 may be introduced to the pump 22 via the suction pipe 37 and the suction tube 40 even when the pump 22 is not in operation, and in turn, the air introduced to the pump 22 may push open a suction valve and a evacuation valve of the pump 22 to reach the toner hopper 9. When a large amount of air is introduced into the toner hopper 9, toner inside the toner hopper 9 may leak and scatter from the gaps of a box making up the toner hopper 9, for example. However, such a problem may be prevented according to the third embodiment of the present invention.

Also, as in the case of the previously described embodiments, according to the third embodiment of the present invention, air is spouted from the bottom of the particle accommodating unit 31 by the gas spouting unit 33 while toner T within the particle accommodating unit 31 is introduced into the suction pipe 37 to be conveyed to the toner hopper 9 (supply destination). In this way, the accommodating capacity of the toner T may be increased without causing damage to the toner T or requiring complicated replacement operations, fine adjustment of the toner supply amount may be performed, and the toner T may be prevented from scattering to be efficiently and accurately conveyed to the toner hopper 9, for example.

Fourth Embodiment

In the following, a fourth embodiment of the present invention is described with reference to FIG. 15.

Figure 15:
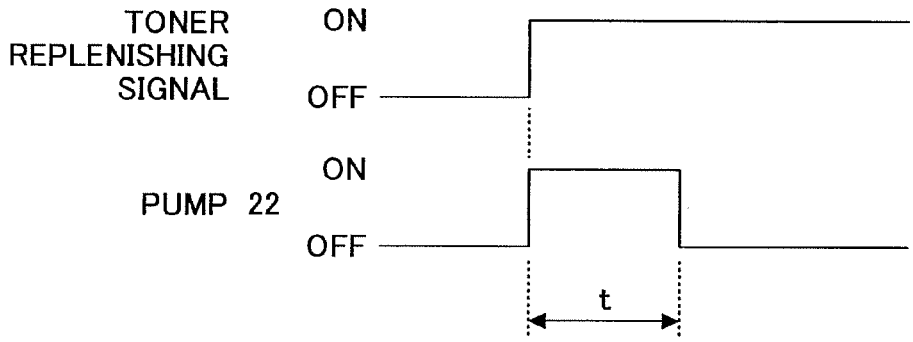
FIG. 15 is a timing chart illustrating control operations for controlling conveying mechanism of a particle supply apparatus according to a fourth embodiment of the present invention.

FIG. 15 is a timing chart illustrating control operations for controlling conveying mechanism of a particle supply apparatus according to the fourth embodiment. It is noted that the method for controlling the conveying mechanism according to the fourth embodiment differs from that used in the first embodiment.

According to the fourth embodiment, operations of the conveying mechanism are controlled so that the conveying mechanism may not be continually operated for over a predetermined period of time regardless of whether a control signal requesting operation of the conveying mechanism is issued. Specifically, as is shown in FIG. 15, even when a control signal requesting operation of the drive motor of the pump 22 for replenishing toner (toner replenishing signal) is continually output from a control unit of the imaging apparatus main frame 1, operations of the drive motor of the pump 22 are forcefully terminated (turned off) after a predetermined time period t elapses from the time the drive motor is turned on. More specifically, the input time of the control signal (toner replenishing signal) input to an operations circuit of the particle supply apparatus 20 from the imaging apparatus main frame 1 is counted by a timer, and the drive motor of the pump 22 is forcefully terminated when the input time exceeds the predetermined time period t.

For example, the predetermined time period t for forcefully shutting down the operations of the drive motor of the pump 22 may be set to five seconds.

By performing the control operations as is described above, toner may be prevented from being excessively supplied to the toner hopper 9 from the toner supply apparatus 20 when a control signal requesting operation of the pump 22 for replenishing toner is continually output from the imaging apparatus main frame 1 due to some malfunction such short circuit or runaway of the circuit, for example.

It is noted that when the pump 22 is continually operated with no limits and toner is excessively supplied from the particle supply apparatus 20 to the toner hopper 9, overflow of toner may occur in the toner hopper 9 to cause toner scattering, for example. In this respect, a time limit is imposed on continual operations of the pump 22 (conveying mechanism) according to the fourth embodiment so that the problems described above may be prevented.

Also, as in the case of the previously described embodiments, according to the fourth embodiment of the present invention, air is spouted from the bottom of the particle accommodating unit 31 by the gas spouting unit 33 while toner T within the particle accommodating unit 31 is introduced into the suction pipe 37 to be conveyed to the toner hopper 9 (supply destination). In this way, the accommodating capacity of the toner T may be increased without causing damage to the toner T or requiring complicated replacement operations, fine adjustment of the toner supply amount may be performed, and the toner T may be prevented from scattering to be efficiently and accurately conveyed to the toner hopper 9, for example.

It is noted that in the above descriptions, the particle supply apparatus 20 that supplies toner to a supply destination is illustrated as preferred embodiments of the present invention; however, the present invention is not limited to such embodiments, and may also be applied to a particle supply apparatus that supplies a two-component developer consisting of toner and a carrier to a supply destination, for example. In this case, a magnetic permeability sensor may be used for detecting the amount of developer remaining in the particle accommodating unit, for example.

Also, it is noted that the present invention may equally be applied to other types of particle supply apparatuses including but not limited to those described below:

(1) Particle supply apparatus that supplies mold material (e.g. pellet) to a resin molding machine (2) Particle supply apparatus that transports flour, fertilizer, or livestock feed, for example (3) Particle supply apparatus used in a production site for conveying medicine in the form of powder, liquid, or tablets, for example (4) Particle supply apparatus that transports cement
(5) Particle supply apparatus that conveys industrial paint by dispersing air into the industrial paint to reduce its viscosity
(6) Particle supply apparatus that conveys industrial glass beads used as components of road paint or internal filling of an air bed, for example In the case where the present invention is applied to a particle supply apparatus that transfers hard particles such as the two-component developer or glass beads, the gas spouting unit 33 may be prone to damage over time when it is made of resin material such as PE or PC, and the holes of the porous member 33B may possibly be clogged as a result, for example. Thus, in such a case, the gas spouting unit 33 is preferably made of a sintered copper/steel member or a fine metal mesh filter, for example.

Also, it is noted that in the above-described embodiments of the present invention, a diaphragm air pump is used as the pump 22 for attracting the toner within the particle accommodating unit 31 by suction and discharging the toner to the toner hopper 9. However, the present invention is not limited to such an embodiment, and other types of pumps such as a screw pump may be used as well.

Also, it is noted that in the above-described embodiments of the present invention, the particle supply apparatus 20 is arranged outside the imaging apparatus main frame 1. However, the present invention is not limited to such an embodiment, and the particle supply apparatus 20 may alternatively be arranged within the imaging apparatus main frame 1.

Fifth Embodiment

In the following, a fifth embodiment of the present invention is described with reference to FIGS. 16-24.

First, the overall configuration and operations of an imaging apparatus according to the fifth embodiment are described with reference to FIGS. 16 and 17.

Figure 16:
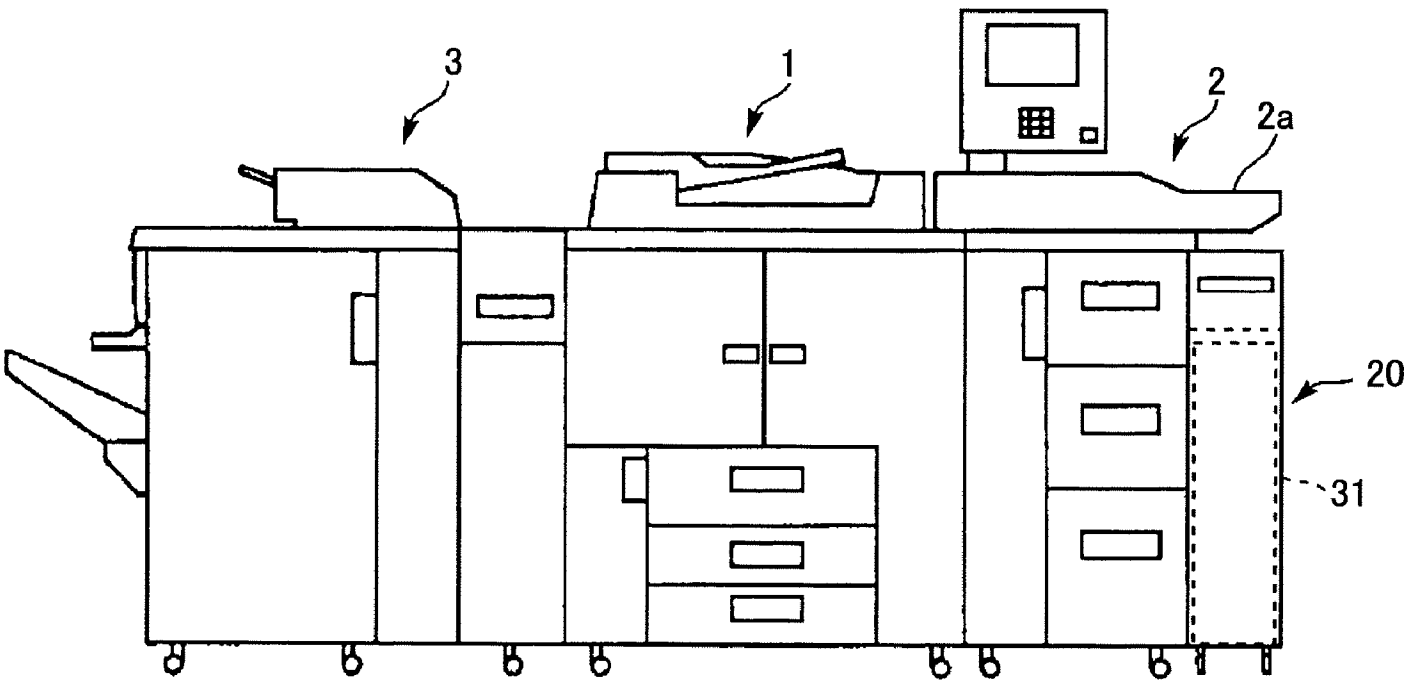
FIG. 16 is a diagram showing an external configuration of an imaging apparatus according to a fifth embodiment of the present invention.

FIG. 16 is a diagram showing an external configuration of the imaging apparatus according to the fifth embodiment. FIG. 17 is a diagram showing configurations of an imaging apparatus main frame and a particle supply apparatus according to the fifth embodiment.

In FIG. 16, an imaging apparatus main frame (copying unit) 1, a paper feed bank (paper feed unit) 2, a post process unit 3 that performs post processes such as sorting and stapling, and a particle supply apparatus (toner supply unit) 20 are illustrated as components of the imaging apparatus according to the present embodiment.

The particle supply apparatus 20 is arranged under a wing 2*a* of a paper feed tray that is placed on top of the paper feed bank 2.

Figure 17:
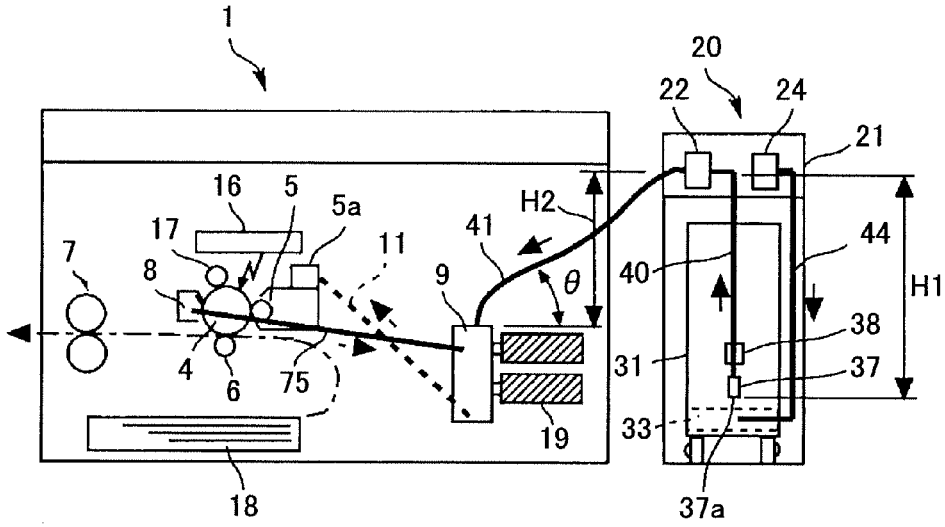
FIG. 17 is a diagram showing configurations of an imaging apparatus main frame and a particle supply apparatus according to the fifth embodiment.

In FIG. 17, the imaging apparatus main frame 1 includes a photoconductor drum 4 as an image holding element, a developing unit (developer) 5 that develops a latent image formed on the photoconductor drum 4, a transfer unit 6 that transfers a toner image formed on the photoconductor drum 4 onto a recording medium such as paper, a fixing unit 7 that fixes toner that is transferred onto the recording medium, a cleaning unit 8 that collects untransferred toner that is remaining on the photoconductor drum 4, an exposure unit 16 that irradiates exposure light on the photoconductor drum 4 based on image information read by a document read unit, a charge unit 17 that charges the surface of the photoconductor drum 4, and a paper feed unit 18 that accommodates recording medium such as paper.

The imaging apparatus main frame 1 also includes a toner hopper (toner receiving unit) 9 as a supply destination for the toner being supplied from the particle supply apparatus 20, a toner conveying channel 11 for conveying the toner within the toner hopper 9 to a toner replenishing unit 5*a* of the developing unit 5, and toner containers (toner bottles) 19 as a secondary particle accommodating unit that supplies toner to the toner hopper 9 in addition to the particle supply apparatus 20.

Further, the imaging apparatus main frame 1 includes a supply channel (recycling channel) 75 as a recycling route for conveying the untransferred toner collected by the cleaning unit 8 to the toner hopper 9. In certain embodiments, the supply channel 75 may use a conveyor screw or a pump such as a diaphragm air pump, for example.

In the following, normal imaging operations of the imaging apparatus according to the fifth embodiment are described with reference to FIG. 17.

First, a document is conveyed by a conveying roller of a document conveying unit from a document table to pass a document read unit. At this point, the document read unit optically reads image information of the passing document.

Then, the optical image information read by the document read unit is converted into an electrical signal to be transmitted to the exposure unit 16. In turn, the exposure unit 16 irradiates exposure light such as laser on the photoconductor drum 4 based on the electrical signal of the image information.

The photoconductor drum 4 rotates in the clockwise direction in FIG. 17. The surface of the photoconductor drum 4 is evenly charged by the charge unit 17 when it reaches the position opposing the charge unit 17. The surface of the photoconductor 4 charged by the charge unit 17 then reaches an exposure light irradiation position, and a latent image corresponding to the image information is formed at this irradiation position.

Then, the surface of the photoconductor drum 4 having the latent image formed thereon reaches a position opposing the developing unit 5 at which position the latent image on the photoconductor drum 4 is developed into a toner image by the developing unit 5.

In the developing unit 5, toner supplied from the toner replenishing unit 5*a* is mixed with a carrier by a paddle roller, for example. Then, the frictionally charged toner and the carrier are supplied to the surface of a developing roller opposing the photoconductor drum 4.

It is noted that toner in the developing unit 5 may be replenished by the toner replenishing unit 5*a* as is necessary in accordance with the consumption of toner within the developing unit 5. The consumption of toner within the developing unit 5 may be detected by a photo sensor arranged opposite the photoconductor 4 or a magnetic permeability sensor arranged within the developing unit 5, for example. The toner in the toner replenishing unit 5*a* may be replenished by supplying toner from the toner hopper 9 via the toner conveying channel 11 that uses a toner conveying coil or a particle pump, for example. The toner in the toner hopper 9 may be replenished by supplying toner from the particle supply apparatus 20 arranged outside the imaging apparatus main frame 1 using conveying mechanism 37, 40, 22, and 41.

According to the fifth embodiment, plural replaceable toner containers 19 are arranged at the toner hopper 9 so that toner may be supplied to the toner hopper 9 from the toner containers 19 as well as the particle supply apparatus 20. For example, the toner containers 19 may be used to supply toner to the toner hopper 9 when replacement operations for replacing the particle accommodating unit 31 of the particle supply unit 20 are being performed. In this way, downtime of the imaging apparatus may be avoided.

Also, according to the fifth embodiment, the toner containers 19 are bottle-shaped containers having spiral projecting portions formed at their inner surfaces. Thus, by rotating the toner container 19, toner within the toner container 19 may be discharged from the opening of the toner container 19 to be supplied to the toner hopper 9.

Then, the surface of the photoconductor drum 4 having the toner image developed by the developing unit 5 reaches a position opposing the transfer unit 6 at which position the transfer unit 6 transfers the toner image formed on the photoconductor drum 4 onto a recording medium such as paper. In this case, a small amount of untransferred toner remains on the surface of the photoconductor drum 4.

Then, the surface of the photoconductor drum 4 having the untransferred toner remaining thereon reaches a position opposing the cleaning unit 8 at which position the untransferred toner is removed by a cleaning blade of the cleaning unit 8 that comes into contact with the surface of the photoconductor drum 4 so that the remaining toner may be collected by the cleaning unit 8. The toner collected by the cleaning unit 8 is conveyed to the toner hopper 9 via the supply channel 75 as recycled toner and is supplied to the developing unit 5 (toner replenishing unit 5*a*) along with fresh toner supplied from the particle supply unit 20 and/or the toner containers 19. In this way, efficient recycle of toner may be realized in the imaging apparatus.

Then, the surface of the photoconductor drum 4 that has passed the cleaning unit 8 reaches a charge removal position (not shown) where the electric potential on the surface of the photoconductor drum 4 is removed so that the imaging operations may be ended.

In the following, operations for handling the recording medium conveyed to the transfer unit 6 are described.

First, one paper feed unit (e.g. paper feed unit 18) is manually or automatically selected from plural paper feed units.

Then, one piece of the recording medium (e.g. paper) accommodated in the selected paper feed unit 18 is moved in the direction of the dot-dashed line shown in FIG. 2 representing a paper conveying route.

Then, the recording medium fed from the paper feed unit 18 is conveyed to the position where a resist roller is arranged. The recording medium reaching the position of the resist roller is synchronized with the photoconductor drum 4 to adjust the positioning of the toner image and is conveyed to the transfer unit 6.

After transfer of the toner image onto the recording medium is completed, the recording medium moves past the transfer unit 6 to reach the position of the fixing unit 7. At this position, the toner image transferred onto the recording medium is fixed by the fixing unit 7 with heat and pressure. Then, after undergoing the fixing process, the recording medium is discharged from the imaging apparatus main frame 1 as an output image and delivered to the post process unit 3 that performs post processes on the discharged recording medium.

In the following, the configuration and operations of the particle supply apparatus 20 are described.

Figure 18:
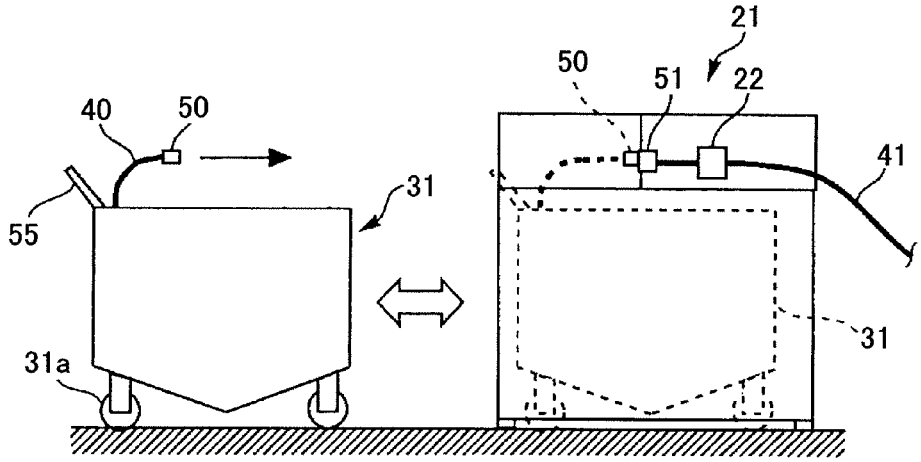
FIG. 18 is a diagram illustrating where a particle accommodating unit is detached from the particle supply apparatus according to the fifth embodiment.
Figure 19:
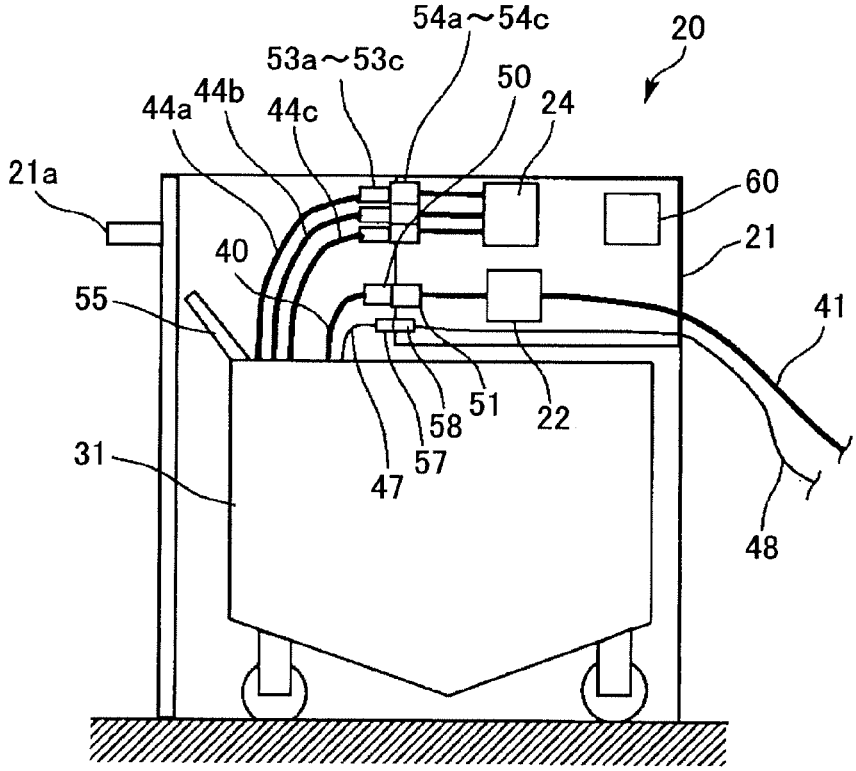
FIG. 19 is a diagram showing a detailed configuration of the particle supply apparatus according to the fifth embodiment.
Figure 20:
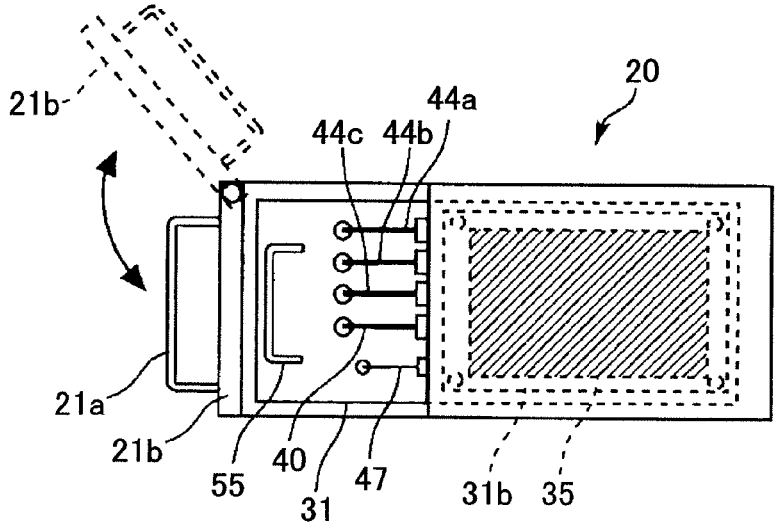
FIG. 20 is a top view of the particle supply apparatus according to the fifth embodiment.
Figure 21:
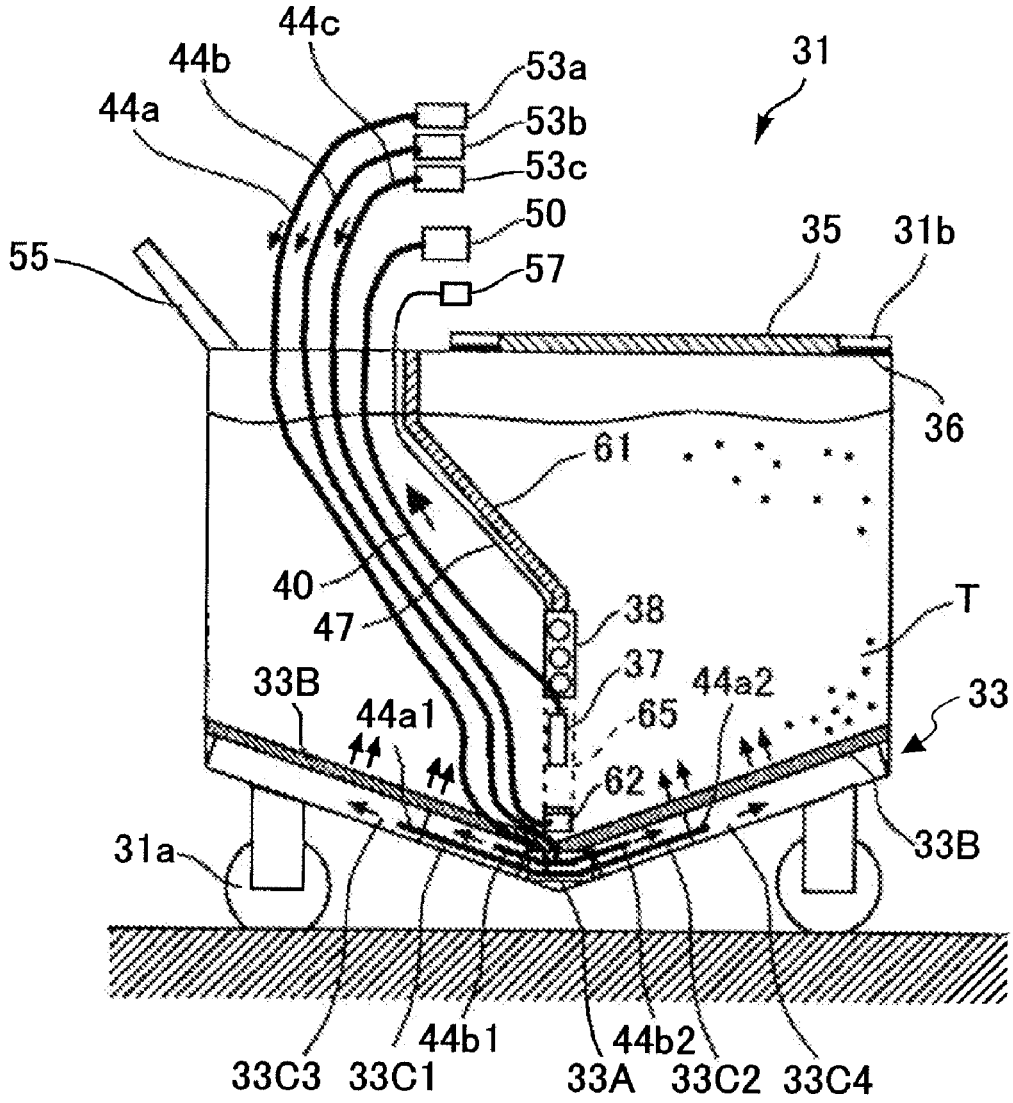
FIG. 21 is a diagram showing a configuration of the particle accommodating unit of the particle supply apparatus according to the fifth embodiment.

FIG. 18 is a diagram illustrating the particle accommodating unit being detached from the particle supply apparatus. FIG. 19 is a diagram showing a configuration of the particle supply apparatus. FIG. 20 is a top view of the particle supply apparatus. FIG. 21 is a diagram showing a configuration of the particle accommodating unit of the particle supply apparatus.

As is shown in FIGS. 17-20, the particle supply apparatus (toner supply unit) 20 includes a particle supply apparatus main frame (fixed unit) 21 that is fixed to the imaging apparatus (paper feed bank 2) and the particle accommodating unit (toner tank unit) 31 that accommodates toner (particles).

As is shown in FIG. 18, the particle accommodating unit 31 is configured to be detachable from the particle supply apparatus main frame 21. Specifically, casters 31*a* are arranged at the four corners of the bottom surface of the particle accommodating unit 31 so that the particle accommodating unit 31 may stand erect and be movable with respect to an installation surface. Also, a gripper 55 is arranged at the upper section of the particle accommodating unit 31. With such an arrangement, an operator such as a user or a serviceperson may grip the gripper 55 and move the particle accommodating unit 31 with respect to the installation surface in the directions indicated by the arrow shown in FIG. 18 using the casters 31*a*.

The particle supply apparatus main frame 21 includes a door 21*b* having a handle 21*a* (see FIG. 20). The door 21*b* may be opened/closed to install/detach the particle accommodating unit 31 into/from the particle supply apparatus main frame 21. In this case, a connection member 50, second connection members 53*a*, 53*b*, a third connection member (fifth connection member) 53*c*, and a fourth connection member 57 of the particle accommodating unit 31 are connected/detached to/from a connection member 51, second connection members 54*a*, 54*b*, a third connection member (fifth connection member) 54*c*, and a fourth connection member 58 of the particle supply apparatus main frame 21 (see FIG. 19).

According to the fifth embodiment, as is shown in FIGS. 18-21, the casters 31*a* are arranged close to the uppermost edge portions of a V-shaped sloping bottom surface of the particle accommodating unit 31 so that the height of the particle accommodating unit 31 including the casters 31*a* may be relatively low. It is noted that although four casters 31*a* are arranged at the four corners of the bottom surface of the particle accommodating unit 31 in the present embodiment, the present invention is not limited to this embodiment, and for example, the number of casters 31*a* and their mounting positions may be arbitrarily adjusted so long as the particle accommodating unit 31 can be stably installed and moved with respect to the installation surface. Also, the arrangement of the grip 55 is not limited to that of the present embodiment, and for example, the mounting position and the shape of the grip 55 may be arbitrarily adjusted in a manner that enables the particle accommodating unit 31 to be easily moved with respect to the installation surface.

In the particle supply apparatus 20 according to the fifth embodiment, the particle accommodating unit 31 may be moved and detached from the particle supply apparatus main frame 21 so that when the particle accommodating unit 31 becomes nearly empty, it may be replaced by another particle accommodating unit 31 that has ample toner accommodated therein. In this way, toner may be continually supplied to the imaging apparatus main frame 1. Also, it is noted that the particle supply apparatus 20 has a separate power supply unit 60 that is independent from the power supply unit for the imaging apparatus main frame 1 so that operations for replacing the particle accommodating unit 31 may be performed without having to turn off the power of the imaging apparatus main frame 1. In other words, the replacement operations may be performed without causing downtime of the imaging apparatus main frame 1.

As is shown in FIG. 19, the particle supply apparatus main frame 21 includes a pump (conveying mechanism) 22 that conveys the toner T accommodated in the particle accommodating unit 31 by suction force and discharges the toner toward a supply destination (toner hopper 9), an air pump 24 that supplies air to a gas spouting unit (fluidized bed) 33 (see FIG. 6) of the particle accommodating unit 31, and the power supply unit 60, for example. In one preferred embodiment, a diaphragm air pump may be used as the pump 22.

It is noted that in the fifth embodiment, the toner hopper 9 of the imaging apparatus main frame 1 corresponds to the supply destination for the toner supplied from the particle supply apparatus 20; however, in an alternative embodiment, the toner replenishing unit 5*a* of the developing unit 5 may be the supply destination for the toner supplied from the particle supply apparatus 20, for example.

As is shown in FIG. 21, the particle accommodating unit 31 includes a suction pipe 37; the gas spouting unit 33; four tubes 40 and 44*a*-44*c* made of flexible silicon rubber; a second gas spouting unit 62; a holding member 65 that holds the second gas spouting unit 62 and the suction pipe 37; a remaining toner sensor (near end sensor) 38 as detection means for detecting the amount of toner remaining in the particle accommodating unit 31; a cable (harness line) 47 electrically connected to the remaining toner sensor 38; and a support member 61 that supports the remaining toner sensor 38, the holding member 65, and the cable 47, for example. Also, the particle accommodating unit 31 accommodates toner T having a volume average particle diameter within a range of 3-15 μm. The horizontal cross section of the particle accommodating unit 31 is arranged into a rectangular shape to secure adequate capacity for accommodating the toner T.

The bottom surface of the particle accommodating unit 31 is arranged into a sloped surface with a center portion arranged at a lowermost position. In other words, the bottom surface of the particle accommodating unit 31 is arranged into a V-shaped sloping surface. The gas spouting unit (fluidized bed) 33 is arranged along the sloping bottom surface of the particle accommodating unit 31.

It is noted that the sloping angle of the sloping bottom surface of the particle accommodating unit 31 is arranged to be smaller than the angle of repose for the toner T accommodated within the particle accommodating unit 31. Specifically, for example, while the angle of repose for the toner T may be approximately 40 degrees, the sloping angle of the sloping surface may be approximately 20 degrees. By arranging the sloping angle of the sloping surface to be relatively small, a dead space created as a result of sloping may be reduced and the toner may be prevented from piling up at a lowermost region (region around the lowermost position) of the sloping surface to excessively increase the bulk density at this region.

The gas spouting unit 33 includes an intermediate unit 33A, a porous member 33B, and four chambers 33C1-33C4, for example, and is configured to spout air (gas) into the particle accommodating unit 31. The lateral cross section (i.e., cross section orthogonal to the air spouting direction) of the gas spouting unit 33 is arranged into a substantially rectangular shape.

The porous member 33B of the gas spouting unit 33 has holes with diameters that are arranged to be smaller than the particle size (diameter) of toner T, and is arranged at a side that comes into direct contact with the toner T accommodated within the particle accommodating unit 31. Air discharged from the air pump 24 of the particle supply apparatus main frame 21 is supplied to the porous member 33B via the tubes 44*a*, 44*b*, and the chambers 33C1-33C4, and the porous member 33B acts as the air spouting outlet for spouting air into the particle accommodating unit 31.

It is noted that the porous member 33B is made of a porous material having fine holes for passing air. The porous member 33B is configured to have an aperture ratio of 5-40% (preferably within 10-20%) and an average aperture diameter of 0.3-20 μm (preferably within 5-15 μm), and the average hole diameter of its holes is arranged to be 0.1-5 times (preferably 0.5-3 times) the volume average particle diameter of the toner T.

The porous member 33B may be made of glass, sintered resin particles, photo-etched resin, thermally perforated resin or some other type of porous resin material, sintered metal, a perforated metal plate material, a mesh laminate, or a metal material having selectively fused holes that may be obtained by causing precipitation of metal copper around fusible metal threads through electrochemical processing to fabricate a copper plate with the fusible metal threads implanted therein and selectively removing the fusible metal threads implanted into the copper plate, for example.

By spouting air toward the toner T accommodated in the particle accommodating unit 31 via the porous member 33B as is described above, the bulk density of the toner may be reduced, the toner T may be fluidized, and cross-linking of the toner T may be prevented, for example. It is noted that since each toner particle weighs relatively little and a relatively strong air pressure is applied to the porous member 33B, it is unlikely for a toner particle to penetrate the chambers 33C1-33C4 or clog up the porous member 33B even when the toner particle enters a hole of the porous member 33B.

As is shown in FIG. 21, four independent chambers 33C1-33C4 are arranged below the porous member 33B.

Specifically, the first chamber 33C1 and the second chamber 33C2 are adjacent to the intermediate unit 33A that is arranged at the lowermost region of the sloping bottom surface. The first chamber 33C1 receives air from the air pump 24 that is conveyed through the second connection members 53*b*, 54*b* (intermediate pipes), and the tube (second tube) 44*b*, and diverged by the intermediate unit 33A via a discharge outlet 44*b*1. The second chamber 33C2 receives air from the air pump 24 that is conveyed through the second connection members 53*b*, 54*b* and the second tube 44*b*, and diverged by the intermediate unit 33A via a discharge outlet 44*b*2. The air supplied to the first chamber 33C1 and the second chamber 33C2 is spouted at the lowermost region of the sloping surface of the particle accommodating unit 31 via the porous member 33B.

The third chamber 33C3 and the fourth chamber 33C4 are adjacent to the first chamber 33C1 and the second chamber 33C2, respectively. The third chamber 33C3 receives air from the air pump 24 that is conveyed via the second connection members 53*a*, 54*a*, and the tube (first tube) 44*a*, and diverged by the intermediate unit 33A via a discharge outlet 44*a*1. The fourth chamber 33C4 receives air from the air pump 24 that is conveyed via the second connection members 53*a*, 54*a*, and the first tube 44*a*, and diverged by the intermediate unit 33A via a discharge outlet 44*a*2. The air supplied to the third chamber 33C3 and the fourth chamber 33C4 is spouted at regions of the sloping bottom surface other than the lowermost region via the porous member 33B.

As can be appreciated from the above descriptions, in the present embodiment, the particle accommodating unit 31 includes the second connection members 53*a* and 53*b*, and the particle supply apparatus main frame 21 includes the second connection members 54*a* and 54*b*. When the particle accommodating unit 31 is installed in the particle supply apparatus main frame 21, these second connection members 53*a*, 53*b*, 54*a*, and 54*b* establish intermediate connections within gas conveying paths extending from the air pump 24 to the gas spouting unit 33. On the other hand, when the particle accommodating unit 31 is detached from the particle supply apparatus main frame 21, the gas conveying paths are disconnected. In this way, the particle accommodating unit 31 may be easily attached/detached to/from the particle supply apparatus main frame 21.

It is noted that the area (i.e. area of contact surface that is in contact with the porous member 33B) or the volume of the first chamber 33C1 and the second chamber 33C2 is arranged to be smaller than the area or volume of the third chamber 33C3 and the fourth chamber 33C4.

By arranging the gas spouting unit 33 to have the above-described configuration, the gas spouting amount per unit area per unit time at the lowermost region of the sloping surface (where the first chamber 33C1 and the second chamber 33C2 are arranged) may be greater than the gas spouting amount per unit area per unit time at other regions of the sloping surface (where the third chamber 33C3 and the fourth chamber 33C4 are arranged). It is noted that the toner at the lowermost region of the sloping surface tends to have a higher bulk density compared to the rest of the regions of the sloping surface. Thus, by varying the gas spouting amount of the gas spouting unit 33 for the different positions on the sloping surface, uniform fluidity of the toner may be achieved throughout the sloping surface in an efficient manner, for example.

As can be appreciated from the above descriptions, according to the fifth embodiment, plural chambers (e.g., first through fourth chambers 33C1-33C4) are provided at the gas spouting unit 33, and air from the air pump 24 is individually supplied to the different chambers so that the gas spouting amount may be varied for the different positions on the sloping surface. In the present embodiment, the difference in the gas spouting amount is created by varying the size of the chambers (area or volume of the chambers 33C1-33C4) from which air is spouted.

However, it is noted that measures for varying the gas spouting amount is not limited to the above-described embodiment, and other measures may be implemented such as arranging different porous members (e.g., having different hole diameters and/or hole densities) at different positions of the sloping surface, or varying the air pressure of air discharged from the air pump 24.

In a preferred embodiment, the gas spouting amount per unit area per unit time at the lowermost region of the sloping surface (where the first chamber 33C1 and the second chamber 33C2 are arranged) may be adjusted to be 1.1-2 times greater than the spouting amount per unit area per unit time at the other regions of the sloping surface (where the third chamber 33C3 and the fourth chamber 33C4 are arranged) in order to achieve advantageous effects as described above such as reduced toner bulk density and uniform toner fluidity, for example.

It is noted that the suction pipe 37 is arranged above the intermediate unit 33A (the lowermost position of the sloping surface) so that the toner T may be efficiently introduced into the suction pipe 37 even when the amount of toner T remaining in the particle accommodating unit 31 becomes small. The suction pipe 37 is connected to one end of the pump 22 via the suction tube 40, and the connection members 50 and 51. The other end of the pump 22 is connected to the toner hopper 9 of the imaging apparatus main frame 1 via a discharge tube (conveying mechanism) 41. According to the present embodiment, the suction pipe 37, the suction tube 40, and the connection members 50 and 51 form a particle suction path from the particle accommodating unit 31 to the pump 22, and the discharge tube 41 forms a particle discharge path from the pump 22 to the toner hopper 9. When the pump 22 is activated, the toner T within the particle accommodating unit 31 is introduced into the suction pipe 37 via a suction port 37*a* and is conveyed to the toner hopper (supply destination) via the pump 22.

As can be appreciated from the above descriptions, in the present embodiment, the particle accommodating unit 31 includes that connection member 50, and the particle supply apparatus main frame 21 includes the connection member 51. When the particle accommodating unit 31 is installed into the particle supply apparatus main frame 21 these connection members 50 and 51 establish intermediate connection within the particle suction path extending from the suction port 37*a* to the pump 22. On the other hand, when the particle accommodating unit 31 is detached from the particle supply apparatus main frame 21, the particle suction path is disconnected. In this way, the particle accommodating unit 31 may be easily attached/detached to/from the particle supply apparatus main frame 21.

In a preferred embodiment, the suction tube 40 and the discharge tube 41 are made of silicon rubber that has low toner affinity so that the toner T may be prevented from bonding with the tube to degrade toner transferability, for example.

In another preferred embodiment, at least a part of the particle suction path and the particle discharge path is made of a flexible tube (e.g. tubes 40 and 41) in order to allow flexibility in the layout of the particle accommodating unit 31, the pump 22, and the toner hopper 9.

In FIG. 17, the pump 22 is positioned above the toner hopper 9 corresponding to the toner supply destination. Accordingly, the toner T that is introduced into the pump 22 is discharged to the toner hopper 9 that is positioned lower than the pump 22. With such an arrangement, toner may be accurately conveyed with a relatively small discharge force owing to the positional level difference between the pump 22 and the toner hopper 9 even when the distance from the pump 22 to the toner hopper 9 is relatively long, for example.

In another preferred embodiment, the slope angle θ of the particle discharge path formed by the discharge tube 41 may be within 20-90 degrees (more preferably within 25-45 degrees). In this way, toner may be efficiently conveyed through the particle discharge path by the discharge force of the pump 22 as well as the gravitational falling force created by the slope angle.

Also, in the fifth embodiment, the suction port 37*a* (suction pipe 37) of the particle suction path is positioned lower than the pump 22. Specifically, the toner T within the particle accommodating unit 31 is introduced into the suction pipe 37 (e.g., having an internal diameter of approximately 6-8 mm) positioned at the lowermost region of the particle accommodating unit 31 and conveyed upward by suction force. In a preferred embodiment, the distance between the pump 22 and the suction pipe 37 is arranged to be shorter than the distance between the pump 22 and the toner hopper 9 in order to reduce the suction force of the pump 22 required for conveying the toner T upward against the gravitational force so that the toner T within the particle accommodating unit 31 may be efficiently conveyed by suction force. Also, since the toner T is directed upward in the particle suction path, the toner T may be prevented from scattering in large amounts when the suction tube 40 is damaged or detached; that is, the scattered toner may be limited to that flowing within the suction tube 40, for example.

In another preferred embodiment, the vertical distance H1 between the suction port 37*a* of the suction pipe 37 and the pump 22 may be 1.5-2 times the vertical distance H2 between the toner hopper 9 and the pump 22 (see FIG. 17). In this way, overall balance may be maintained in the conveying path for conveying toner from the suction port 37*a* of the suction pipe 37 to the toner hopper 9 via the pump 22.

Also, in the fifth embodiment, the pump 22 (particle supply apparatus main frame 21) and the particle accommodating unit 31 are arranged outside the imaging apparatus main frame 1 so that the configuration of the particle supply apparatus 20 may not be restricted by the configuration of the imaging apparatus main frame 1. For example, the pump 22 may be arranged at a desired position regardless of the height of the imaging apparatus main frame 1. In another example, the imaging apparatus main frame 1 may be stationed within an office space whereas the particle supply apparatus 20, which is prone to cause tainting by toner, may be stationed outside the office space.

Figure 22:
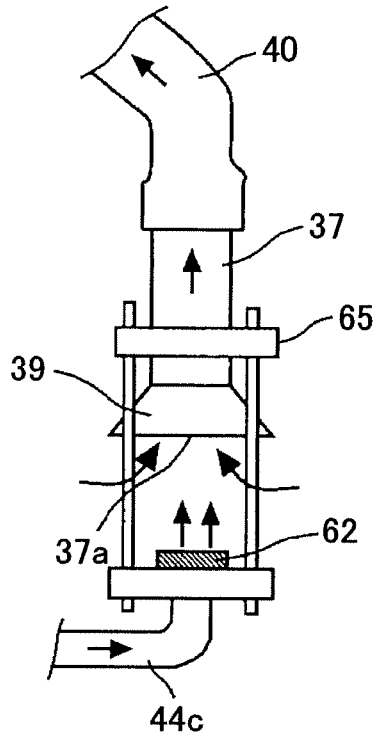
FIG. 22 is an enlarged partial view of an area surrounding a suction tube.

FIG. 22 is a diagram illustrating in detail the suction pipe 37 and elements associated therewith. As is shown in this drawing, the suction pipe 37 is fixed to the holding member 65 that is supported by the support 61 (see FIG. 21). The second gas spouting unit 62 held by the holding member 65 is arranged below the suction pipe 37. The holding member 65 (and support 61) is configured to fix the position of the suction pipe 37 within the particle accommodating unit 31 and the position of the second gas spouting unit 62 with respect to the suction pipe 37.

The second gas spouting unit 62 spouts air from the air pump 24 that is conveyed via the third connection members 53*c*, 54*c*, and the tube (third tube) 44*c* directly toward the suction port 37*a* of the suction pipe 37. The second spouting unit 62 may include a porous member (and possibly one or more chambers), for example. It is noted that the second gas spouting unit 62 of the fifth embodiment is also configured to spout air toward the remaining toner sensor 38 shown in FIG. 21.

The porous material of the second gas spouting unit 62 may be identical to the material used for the porous material 33B of the gas spouting unit 33. In this way, the bulk density of the toner T around the suction port 37*a* of the suction pipe 37 may be reduced and the toner may be fluidized so that clogging of the conveying mechanism 22, 37, 40, and 41 may be prevented and toner transferability may be improved, for example. Also, the toner T around the remaining toner sensor 38 may be fluidized so that detection performance of the remaining toner sensor 38 may be stabilized, for example.

As can be appreciated from the above descriptions, in the present embodiment, the particle accommodating unit 31 includes the third connection member (or fifth connection member) 53*c*, and the particle supply apparatus main frame 21 includes the third connection member (or fifth connection member) 54*c*. When the particle accommodating unit 31 is installed in the particle supply apparatus main frame 21, these third connection members (or fifth connection members) 53*c* and 54*c* establish intermediate connections within a gas conveying path extending from the air pump 24 to the second gas spouting unit 62. On the other hand, when the particle accommodating unit 31 is detached from the particle supply apparatus main frame 21, the gas conveying path is disconnected. In this way, the particle accommodating unit 31 may be easily attached/detached to/from the particle supply apparatus main frame 21.

It is noted that in the present embodiment, the second gas spouting unit 62 is used to spout air toward the suction port 37*a* of the suction pipe 37 and the remaining toner sensor 38; however, the present invention is not limited to such an embodiment and for example, a gas spouting unit for spouting air toward the suction port 37*a* of the suction pipe 37 and a gas spouting unit for spouting air toward the remaining toner sensor 38 may be separately provided. In another alternative embodiment, the second gas spouting unit 62 and the gas spouting unit 33 arranged at the bottom of the particle accommodating unit 31 may be combined to form one gas spouting unit, for example.

Also, as is shown in FIG. 22, in the fifth embodiment, a rectifying member 39 is provided at the suction port 37*a* of the suction pipe 37. The rectifying member 39 is a funnel-shaped member that enlarges the opening area of the suction port 37*a* to increase the suction force of the suction port 37*a*.

Figure 23:
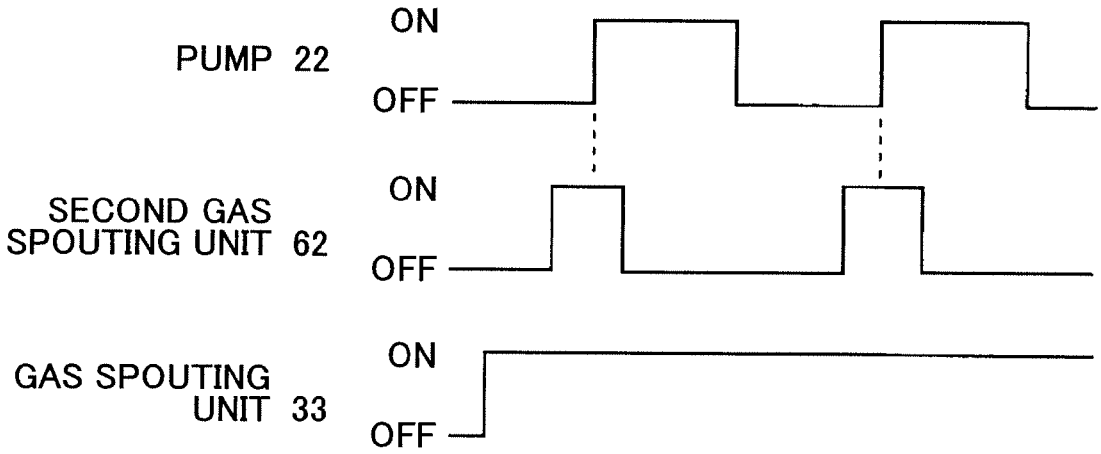
FIG. 23 is a timing chart illustrating control operations for controlling a second gas spouting unit.

FIG. 23 is a timing chart illustrating operations of the particle supply apparatus 20 according to the fifth embodiment. As is shown in this drawing, before suction operations of the pump 22 (fluid suction via the suction pipe 37) are started, operations of the second gas spouting unit 62 for spouting air toward the suction port 37*a* are started. In this way, fluidization of toner may be ensured at the time toner is introduced into the suction pipe 37 so that toner transfer may be smoothly performed by the conveying mechanism 22, 37, 40, and 41.

Also, the operations of the second gas spouting unit 62 for spouting air toward the suction port 37*a* are ended before the suction operations by the pump 22 (fluid suction via the suction pipe 37) are ended. Specifically, once the fluidity of toner is induced by the second gas spouting unit 62 right before toner suction operations via the suction pipe 37 are started, the toner transfer operations may be smoothly performed by the conveying mechanism 22, 37, 40, and 41 without continuing the operations of the second gas spouting unit 62. Accordingly, in the present embodiment, the operations of the second gas spouting unit 62 are terminated after a predetermined time elapses from the time operations of the pump 22 are started in order to reduce the duty time of the second gas spouting unit 62.

As is shown in FIG. 23, the operations of the gas spouting unit 33 (33A, 33B, 33C1-33C4) are performed independently from the operations of the second gas spouting unit 62 in the present embodiment. The operations of the gas spouting unit 33 may be continually performed, intermittently performed, or performed according to the decrease in fluidity of the toner within the particle accommodating unit 31 (e.g., at predetermined time intervals), for example. In one embodiment, the timing for supplying air to the first chamber 33C1 and the second chamber 33C2 and the timing for supplying air to the third chamber 33C3 and the fourth chamber 33C4 may be varied in order to obtain uniform fluidity of the toner within the particle accommodating unit 31 in an efficient manner, for example.

In another embodiment, operations of the second gas spouting unit 62 may be intermittently performed while the pump 22 is in operation so that toner transferability may be improved in a case where the pump 22 is continually operated for a long period of time, for example.

In another embodiment, operations of the second gas spouting unit 62 may be intermittently performed in a case where the pump 22 is not operated (abandoned) for a long period of time so that toner transfer operations may be smoothly performed in response to activation of the pump 22 even after the pump has been abandoned for a long period of time, for example.

In another embodiment, the second gas spouting unit 62 may be forcefully operated for a predetermined period of time when the main switch of the imaging apparatus main frame 1 is turned on. In this way, warm up operations may be performed in the particle supply apparatus 20 in conjunction with warm up operations of the imaging apparatus main frame 1 and smooth toner transfer operations may be immediately performed in response to activation of the second gas spouting unit 62, for example.

It is noted that in the fifth embodiment, three tubes 44*a*-44*c* are used to separately supply air to the third chamber 33C3 and fourth chamber 33C4, the first chamber 33C1 and second chamber 33C2, and the second gas spouting unit 62, respectively. In this way, air flow and air pressure may be easily adjusted according to the characteristics of the different air supply destinations, for example.

Referring to FIGS. 20 and 21, the particle accommodating unit 31 has an opening and a filter (evacuation member) 35 covering the opening arranged at its upper face. The filter 35 prevents the toner T within the particle accommodating unit 31 from leaking outside and prevents the internal pressure of the particle accommodating unit 31 from increasing. Specifically, the filter 35 and the opening embody a gas discharge unit (depressurizing unit) for discharging gas (but not toner) from the particle accommodating unit 31 to prevent the internal pressure of the particle accommodating unit 31 from increasing. More specifically, the filter 35 and the opening prevent the internal pressure of the particle accommodating unit 31 from increasing as a result of gas (air) being supplied thereto from the gas spouting unit 33 and the second gas spouting unit 62.

It is noted that the filter 35 is preferably made of a porous member. Specifically, the filter 35 may be made of a material that is identical to that used for the porous member 33B, or some other material such as GORE-TEX (registered trademark of Japan Gore-Tex, Inc.) corresponding to a porous fluorine resin material, for example. By using a porous member as the filter 35, clogging of the filter 35 may be reduced and stability of performance over a long period of time may be achieved, for example.

In one preferred embodiment, the gross area of the holes of the porous member making up the filter 35 is arranged to be larger than the gross area of the holes of the porous member making up the gas spouting unit 33 so that the internal pressure of the particle accommodating unit 31 may be effectively prevented from increasing, for example.

It is noted that in the above preferred embodiment, the gross area of the holes of the porous member making up the second gas spouting element 62 is not taken into account since the operating rate of the second gas spouting unit 62 is lower than that of the gas spouting unit 33 in the present embodiment (as is described above in relation to FIG. 23). However, in a case where the operating rate of the second gas spouting unit 62 is relatively high, the gross area of the holes of the porous member making up the second gas spouting unit 62 may preferably be taken into account. In this case, the gross area of the holes of the porous member making up the filter is preferably arranged to be larger than the gross area of the holes of the porous members making up the gas spouting unit 33 and the second gas spouting unit 62.

It is noted that the filter 35 may be positioned at any position above the toner load line of the particle accommodating unit 31 formed when the toner is full. For example, the filter 35 does not necessarily have to be provided at the upper face of the particle accommodating unit 31 and may alternatively be arranged at a side face of the particle accommodating unit 31. By arranging the filter 35 above the toner load line, the filter 35 may not be immersed in toner so that degradation of the filtering performance of the filter 35 may be prevented, for example.

Also, in the fifth embodiment, the filter 35 and the opening as the gas discharge unit are arranged at a lid 31*b* that is detachably arranged at a portion of the ceiling of the particle accommodating unit 31. The lid 31*b* is formed at the particle accommodating unit 31 so that toner may be filled into the particle accommodating unit 31 during its manufacturing process.

By arranging the filter 35 at the detachable lid 31*b*, the filter 35 may be easily cleaned when it gets clogged, for example. Specifically, cleaning of the filter 35 may be effectively performed by applying suction to the side of the filter 35 facing the interior of the particle accommodating unit 31 with a vacuum cleaner, for example. In the present embodiment, such cleaning operations may be easily performed by detaching the lid 31*b* from the particle accommodating unit 31.

Also, in the fifth embodiment, the lid 31*b* is fastened to the particle accommodating unit 31 with plural bolts via a sealing member 36 that may be made of rubber or foamed polyurethane, for example. In this way, the particle accommodating unit 31 may be adequately sealed so that toner within the particle accommodating unit 31 may be prevented from leaking and scattering to the exterior.

Figure 24:
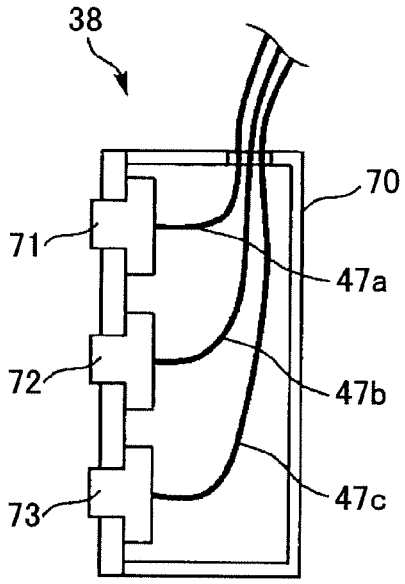
FIG. 24 is a cross-sectional view of a remaining toner sensor.

FIG. 24 is a diagram showing a detailed configuration of the remaining toner sensor 38. As is shown in this drawing, the remaining toner sensor 38 includes three piezoelectric sensors 71-73 that are aligned in the vertical direction. The three piezoelectric sensors 71-73 are held by a case 70 that is supported by the support 61. The three piezoelectric sensors 71-73 are electrically connected to cables 47*a*-47*c*, respectively, and the cables 47*a*-47*c* are bound together within the case 70 to form a bundled cable 47 that is supported by the support 61 and electrically connected to a control unit of the imaging apparatus main frame 1 via the fourth connection members 57, 58, and a cable 48 (see FIG. 18). It is noted that the term "cable" is used in the present application to refer to any type of electrical wire.

As can be appreciated from the above descriptions, in the present embodiment, the particle accommodating unit 31 includes the fourth connection member 57, and the particle supply apparatus main frame 21 includes the fourth connection member 58. When the particle accommodating unit 31 is installed in the particle supply apparatus main frame 21, the fourth connection members 57 and 58 establish intermediate connection within the bundled cable 47 (electrical path) extending from the remaining toner sensor 38 to the particle supply apparatus main frame 21. On the other hand, when the particle accommodating unit 31 is detached from the particle supply apparatus main frame 21, the bundled cable 47 is disconnected. In this way, the particle accommodating unit 31 may be easily attached/detached to/from the particle supply apparatus main frame 21.

In the present embodiment, the remaining toner sensor 38 is configured to inform a user of the remaining amount of toner within the particle accommodating unit 31 by measuring the remaining amount of toner on a scale of three different levels.

Specifically, when the uppermost piezoelectric sensor 71 of the remaining toner sensor 38 detects that there is no toner at its corresponding position (height), a message indicating that the remaining amount of toner within the particle accommodating unit 31 is decreasing may be displayed at a display unit of the imaging apparatus main frame 1 ("PRE NEAR END" display). Then, when the middle piezoelectric sensor 72 of the remaining toner sensor 38 detects that there is no toner at its corresponding position (height), a message indicating that the toner within the particle accommodating unit 31 is almost gone may be displayed at the display unit of the imaging apparatus main frame 1 ("NEAR END" display). Then, when the lowermost piezoelectric sensor 73 of the remaining toner sensor 38 detects that there is no toner at its corresponding position (height), a message indicating that there is not toner remaining in the particle accommodating unit 31 may be displayed at the display unit of the imaging apparatus main frame 1 ("TONER END" display) and suction operations of the pump 22 may be stopped until replacement operations for replacing the particle accommodating unit 31 are completed, for example.

It is noted that the remaining toner sensor 38 is arranged outside the suction pipe 37 in the present embodiment so that toner clumps may be prevented from being generated within the suction pipe 37.

Also, the remaining toner sensor 38 is positioned above the suction port 37*a* of the suction pipe 37 in the present embodiment so that cases in which only air is introduced into the suction pipe 37 may be prevented. Specifically, the remaining toner sensor 38 may be used to send a signal to stop toner suction operations by the pump 22 while the toner is still at a position (level) above the suction port 37*a*. In this way, the suction pipe 37 may be prevented from merely introducing air by suction when the toner is already gone (or when the mixing rate of toner with respect to air is low).

Also, the remaining toner sensor 38 is positioned above the gas spouting unit 33 in the present embodiment so that the remaining toner detection accuracy of the remaining toner sensor 38 may be improved, for example. Specifically, by having the gas spouting unit 33 fluidize the toner and detecting the amount of the fluidized toner remaining in the particle accommodating unit 31, the toner remaining amount may be stably and accurately detected, for example.

Also, the remaining toner sensor 38 is positioned above the lowermost position of the sloping surface of the gas spouting unit 33 in the present embodiment so that the remaining toner sensor 38 may accurately detect the remaining amount of toner within the particle accommodating unit 31 being introduced into the suction tube 37 that is also positioned above the lowermost position to enable efficient and economical transfer of the toner.

Also, it is noted that the remaining toner sensor 38 may be accurately positioned with respect to the particle accommodating unit 31 by the support 61 and the holder 70 in the present embodiment.

Also, the second gas spouting unit 62 is arranged below the remaining toner sensor 38 in the present embodiment so that the toner around the remaining toner sensor 38 may be fluidized and the detection accuracy of the remaining toner sensor 38 may be improved, for example.

As can be appreciated from the above descriptions, according to the fifth embodiment, air is spouted from the bottom of the particle accommodating unit 31 by the gas spouting unit 33 while the toner T within the accommodating unit 31 is introduced into the suction pipe 37 to be conveyed to the toner hopper 9 corresponding to the supply destination, and the filter 35 (air discharge means) is arranged at the particle accommodating unit 31 in order to prevent the internal pressure of the particle accommodating unit 31 from increasing. In this way, the toner accommodating capacity may be increased without causing damage to the toner T or requiring complicated replacement operations, fine adjustment of the toner supply amount may be performed, and the toner T may be efficiently and accurately transferred to the toner hopper 9 without causing the toner T to scatter, for example.

It is noted that in the fifth embodiment, the air pump 24 for supplying air to the gas spouting unit 33 and the second gas spouting unit 62 is positioned above the particle accommodating unit 31 of the particle supply apparatus main frame 21; however, the present invention is not limited to such an embodiment, and the air pump 24 may alternatively be positioned below the sloping surface of the particle accommodating unit 31, for example. In such a case, the length of the air conveying path for conveying air to the gas spouting unit 33 and the second gas spouting unit 62 may be reduced so that a pipe may be used instead of a (flexible) tube for forming the air conveying path, for example.

Also, in the fifth embodiment, the particle supply apparatus main frame 21 is arranged outside the imaging apparatus main frame 1; however, the particle supply apparatus main frame 21 may alternatively be arranged inside the imaging apparatus main frame 1. For example, the pump 22, the air pump 24, and the power supply unit 60 may be arranged inside the imaging apparatus main frame 1, and the particle accommodating unit 31 may be configured to be detachable with respect to the imaging apparatus main frame 1.

Sixth Embodiment

In the following, a sixth embodiment of the present invention is described with reference to FIGS. 25-28.

Figure 25:
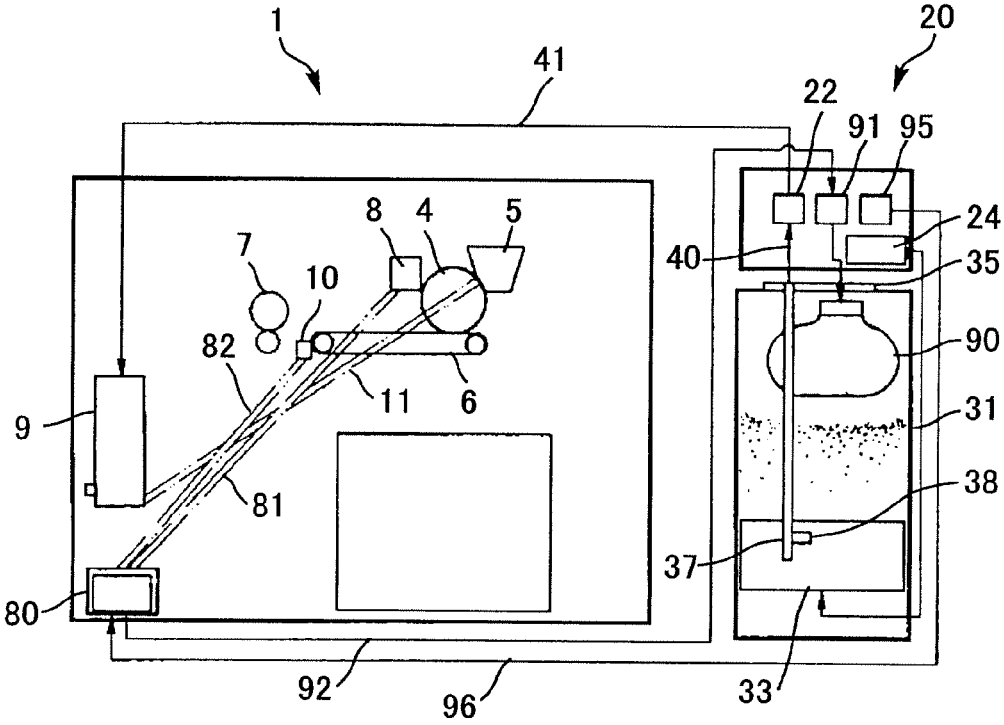
FIG. 25 is a diagram showing configurations of an imaging apparatus main frame and a particle supply apparatus according to a sixth embodiment of the present invention.
Figure 26:
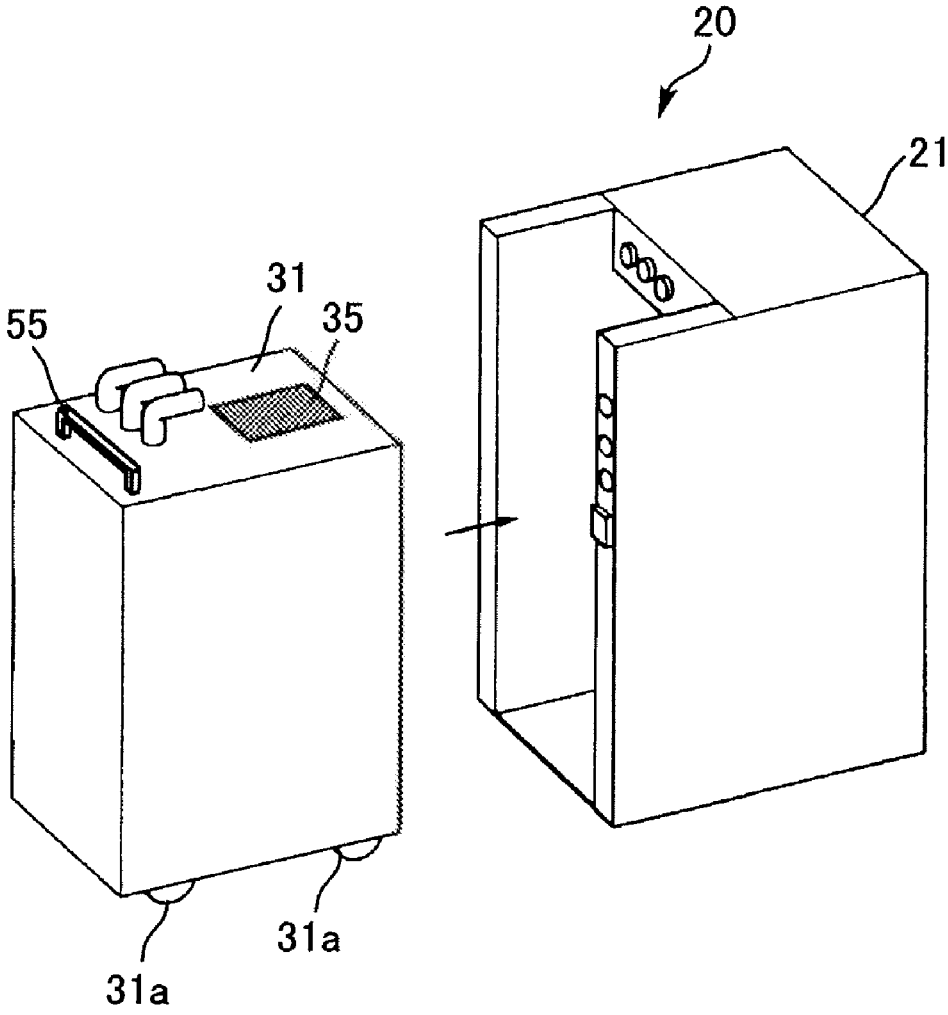
FIG. 26 is a diagram illustrating where a particle accommodating unit is detached from the particle supply apparatus according to the sixth embodiment.
Figure 27:
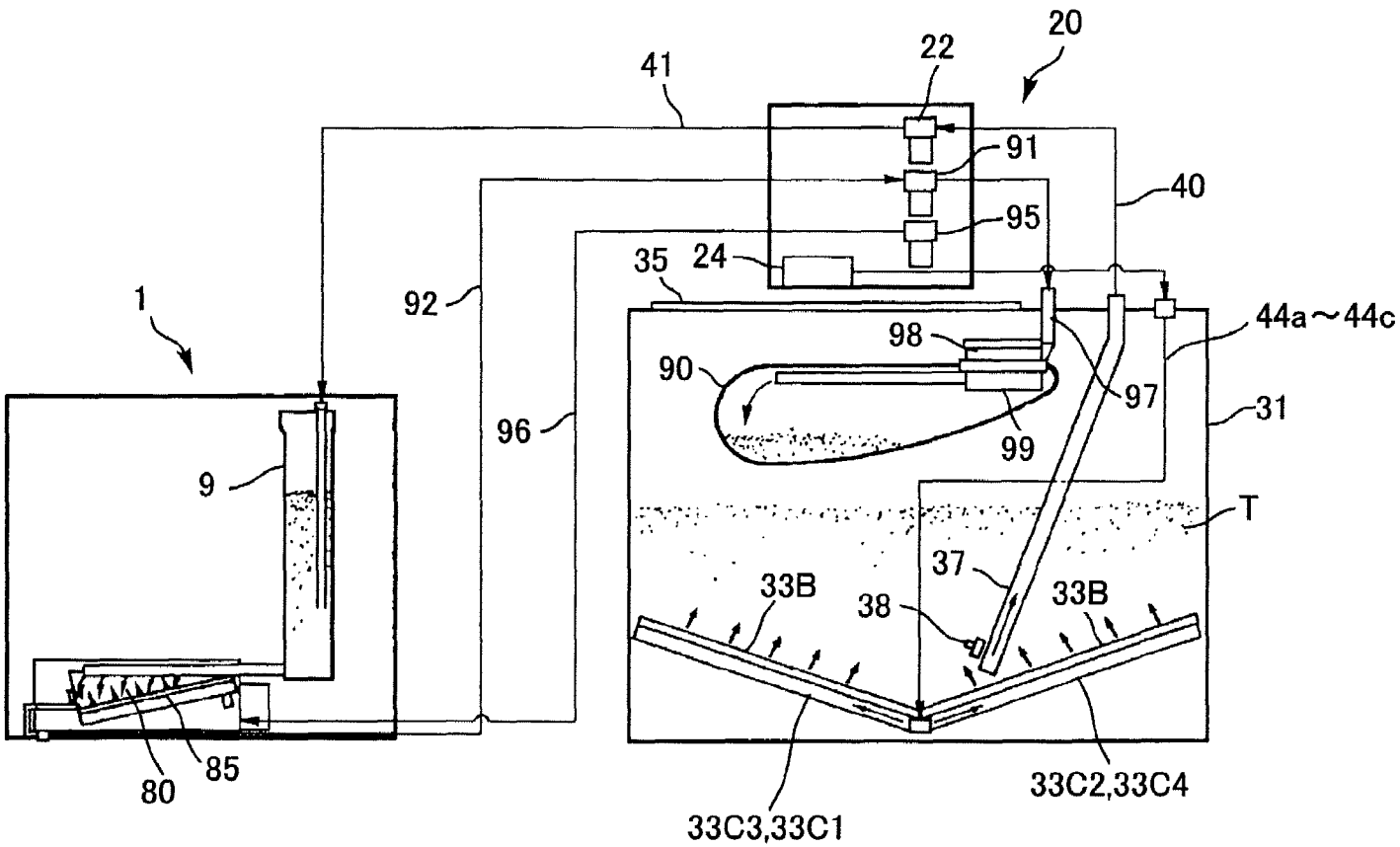
FIG. 27 is a diagram showing detailed configurations of the particle supply apparatus and the imaging apparatus main frame according to the sixth embodiment.
Figure 28:
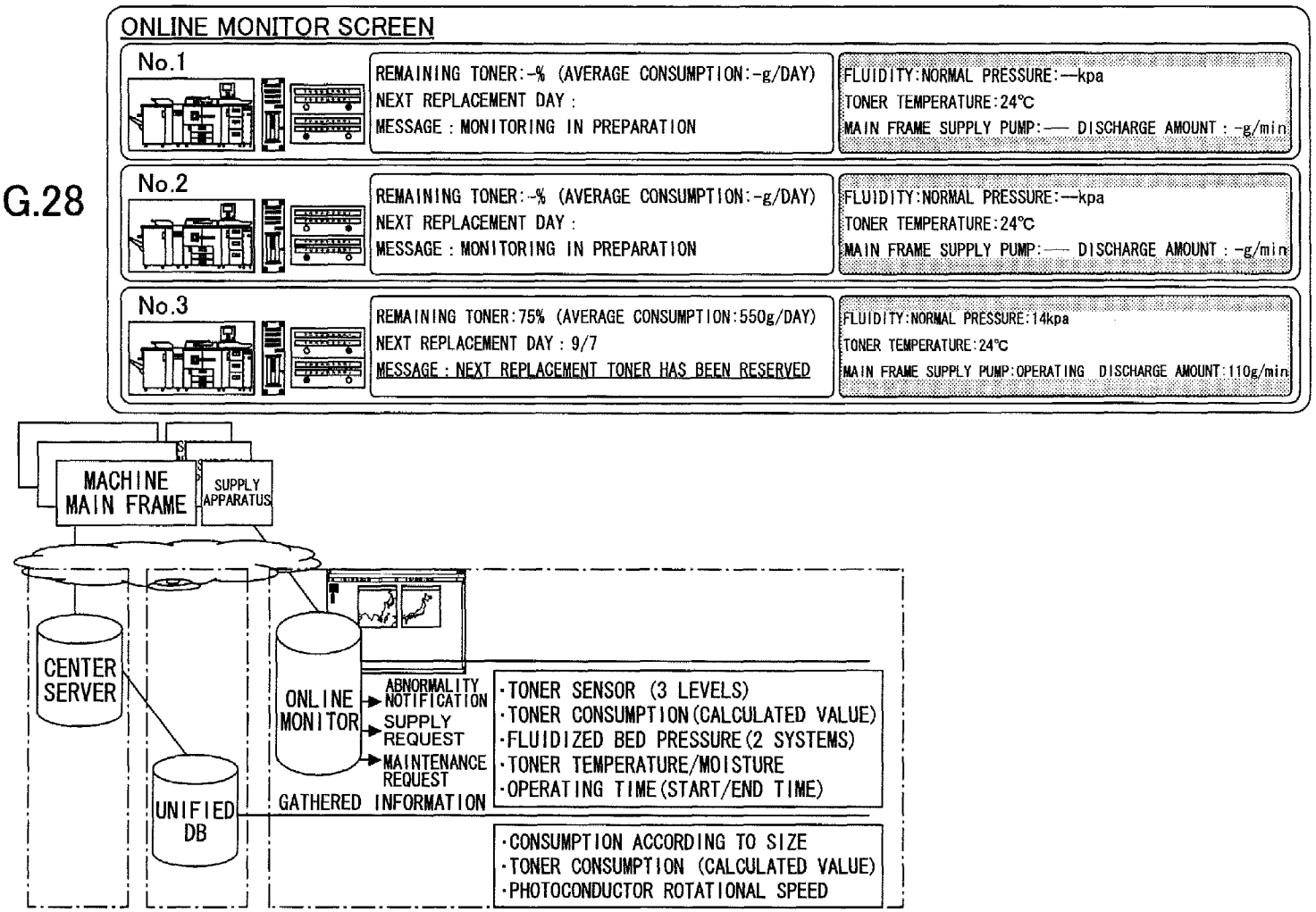
FIG. 28 is a diagram illustrating a monitoring system according to the sixth embodiment.

FIG. 25 is a diagram illustrating overall configurations of an imaging apparatus main frame and a particle supply apparatus according to the sixth embodiment. FIG. 26 is a perspective view of a particle accommodating unit being detached from the particle supply apparatus. FIG. 27 is a diagram illustrating detailed configurations of the imaging apparatus main frame and the particle supply apparatus according to the sixth embodiment. FIG. 28 is a diagram illustrating a monitoring system for monitoring the imaging apparatus according to the sixth embodiment.

It is noted that the imaging apparatus according to the sixth embodiment has a similar configuration to that of the imaging apparatus according to the fifth embodiment and identical components are given the same reference numerals. However, the imaging apparatus according to the sixth embodiment differs from that of the fifth embodiment in that it includes a collection container 90 for accumulating disposal toner within a particle accommodating unit 31 and is connected to a monitoring system via a LAN.

Referring the FIG. 25, the imaging apparatus according to the sixth embodiment includes an imaging apparatus main frame 1 and a particle supply apparatus 20 as with the imaging apparatus according to the fifth embodiment. Also, as is shown in FIGS. 25-27, a filter 35 and an opening (gas discharge unit) are arranged at the ceiling portion of the particle accommodating unit 31.

The imaging apparatus according to the sixth embodiment differs from that of the first embodiment in that untransferred toner that is collected by a cleaning unit 8 is accumulated in the collection container 90 as disposal toner. Specifically, untransferred toner that is collected by the cleaning unit 8 is conveyed to the collection container 90 by second conveying mechanism 81, 80, 92, and 91. Also, a transfer unit according to the sixth embodiment includes a transfer belt 6 and a belt cleaner 10 that collects toner attached to the transfer belt 6, and the toner collected by the belt cleaner 10 may also be conveyed by the second conveying mechanism 81, 80, 92, and 91 to be accumulated in the collection container 90.

It is noted that in a conventional imaging apparatus, a collection container for accumulating untransferred toner collected by a cleaning unit as disposal toner is arranged inside the imaging apparatus main frame, and when the collection container becomes full, operations of the imaging apparatus main frame have to be stopped in order to replace the collection container with a new collection container.

In the sixth embodiment, the particle accommodating unit 31 may accommodate approximately 30-40 kg of toner, for example. In a case where the transfer rate of toner in toner image transfer operations is approximately 90%, 10% (i.e., 3-4 kg) of the toner accommodated in the particle accommodating unit 31 may be collected by the cleaning unit 8 and the belt cleaner 10 as untransferred toner (disposal toner).

It is noted that if a given user consumes approximately 30 kg of toner per month and the transfer rate of toner is approximately 90%, even when a collection container with a relatively large capacity of approximately 10 kg is provided, onerous replacement operations for replacing the collection container 90 may have to be performed once in every 2-3 months in the conventional imaging apparatus, for example. In this respect, measures for enlarging the collection container may be contemplated to reduce the number of times the replacement operations have to be performed. However, it is rather difficult to implement such measures in the conventional imaging apparatus where the collection container is arranged inside the imaging apparatus main frame.

According to the sixth embodiment, the collection container 90 is arranged inside the particle accommodating unit 31 of the particle supply apparatus 20, and thereby, the capacity of the collection container 90 may be increased in accordance with the increase in capacity of the particle accommodating unit 31 without having to enlarge the imaging apparatus main frame 1. Specifically, the toner collected by the cleaning unit 8 and the belt cleaner 10 of the imaging apparatus main frame 1 may be accumulated in the collection container 90 arranged inside the particle accommodating unit 31, and the collection container 90 may be replaced at the same time the particle accommodating unit 31 is replaced. It is noted that FIG. 26 illustrates the particle accommodating unit 31 being detached from the imaging apparatus main frame 21 according to the present embodiment.

In the following, operations for collecting and accumulating disposal toner in the collection container 90 are described.

Referring to FIG. 25, untransferred toner collected by the cleaning unit 8 is temporarily accumulated in a collection unit 80 via a conveying path 81 (second conveying mechanism). Similarly, toner collected by the belt cleaner 10 is temporarily accumulated in the collection unit 80 via a conveying path 82 (second conveying mechanism).

As is shown in FIG. 27, a third gas spouting unit (fluidized bed) including a porous member 85 is arranged at the bottom section of the collection unit 80, and air that is conveyed from an air pump 95 of the particle supply apparatus 20 is supplied to the third gas spouting unit via a tube 96. In this way, air may be spouted from the porous member 85 so that the toner accumulated in the collection unit 80 may be fluidized and the toner may be efficiently conveyed to the collection container 90 via a tube 92 (second conveying mechanism) by the suction force of a pump 91 (second conveying mechanism).

It is noted that the size of the collection container 90 arranged inside the particle accommodating unit 31 may be adjusted to accommodate the estimated amount of toner to be collected which amount may be calculated from the amount of toner accommodated in the particle accommodating unit 31. Accordingly, the size of the collection container 90 may not be excessively large in relativity to the size of the particle accommodating unit 31. Also, since the collection container 90 is arranged within the particle accommodating unit 31, measures do not have to be implemented against external shock and the required durability of the collection container 90 may be reduced, for example.

The collection container 90 according to the sixth embodiment may be a flexible pouch member made of resin material such as a vinyl bag or a poly bag. The collection container 90 may be mounted to a setting unit 99 with a rubber band, for example. The setting unit 99 includes a pipe 97 with a vent that discharges disposal toner and a filter 98 as an evacuation mechanism for discharging air introduced into the collection container 90. By arranging the pipe 97 and the filter 98 to the setting unit 99, the pipe and the filter 98 may be attached to the collection container 90 at once, for example.

It is noted that the imaging apparatus according to the sixth embodiment is connected to a LAN and is monitored by a monitoring system (toner management system) via a network.

FIG. 28 is a diagram illustrating the structure of such a monitoring system.

By structuring the monitoring system as is illustrated in FIG. 28, a serviceperson may be able to monitor use of an imaging apparatus by a given user, and determine in advance the timing for replacing a particle accommodating unit or an abnormality of the imaging apparatus, for example.

Specifically, the monitoring system includes a monitoring apparatus that monitors consumption of the particles accommodated in the particle supply apparatus 20. The monitoring apparatus acquires information pertaining to the remaining toner amount detected by the remaining toner sensor 38 that is arranged within the particle supply apparatus 20. The monitoring apparatus has a transmission function for transmitting information pertaining to monitoring results via a LAN.

It is noted that the monitoring results (monitoring data) obtained by the monitoring apparatus may be transmitted to various departments such as the manufacturing department, the service department, and the sales department of the manufacturer and/or service providing company of the imaging apparatus to be used for production planning, service planning, and sales planning, for example. Specifically, by determining the toner consumption rate, the timing for replacing the particle accommodating unit 31 may be predicted and the particle accommodating unit 31 (and the collection container 90) may be replaced in a timely manner before the toner runs out, for example. In this way, convenient toner end time operations and disposal toner processing operations may be enabled, for example.

It is noted that the inventors of the present invention conducted tests using the monitoring system and the imaging apparatus according to the sixth embodiment where the imaging apparatus includes the collection container 90 with a capacity of 3 liters arranged inside the particle supply apparatus 20 (particle accommodating unit 31) and using a conventional imaging apparatus without the particle supply apparatus 20 (and the collection container 90) as a comparison example. Specifically, the tests were conducted for one week and involved making ten thousand prints per day.

In the case of using the conventional imaging apparatus, disposal toner processing operations had to be performed on an average of once in three days and replacement operations for replacing the toner accommodating unit had to be performed frequently as well so that the downtime of the conventional imaging apparatus amounted to a total of approximately one entire day.

On the other hand, in the case of using the imaging apparatus according to the sixth embodiment and monitoring the imaging apparatus with the monitoring system, no downtime was created in the imaging apparatus, and replacement operations for replacing the particle accommodating unit 31 (and the collection container 90) could be performed in a timely and efficient manner.

Also, as in the case of the fifth embodiment, according to the sixth embodiment of the present invention, air is spouted from the bottom of the particle accommodating unit 31 by the gas spouting unit 33 while toner T within the particle accommodating unit 31 is introduced into the suction pipe 37 to be conveyed to the toner hopper 9 (supply destination), and the filter 35 (gas discharge unit) is arranged at the particle accommodating unit 31 in order to prevent the internal pressure of the particle accommodating unit 31 from increasing. In this way, the accommodating capacity of the toner T may be increased without causing damage to the toner T or requiring complicated replacement operations, fine adjustment of the toner supply amount may be performed, and the toner T may be prevented from scattering to be efficiently and accurately conveyed to the toner hopper 9, for example.

Seventh Embodiment

In the following, a seventh embodiment of the present invention is described with reference to FIGS. 29 and 30.

Figure 29:
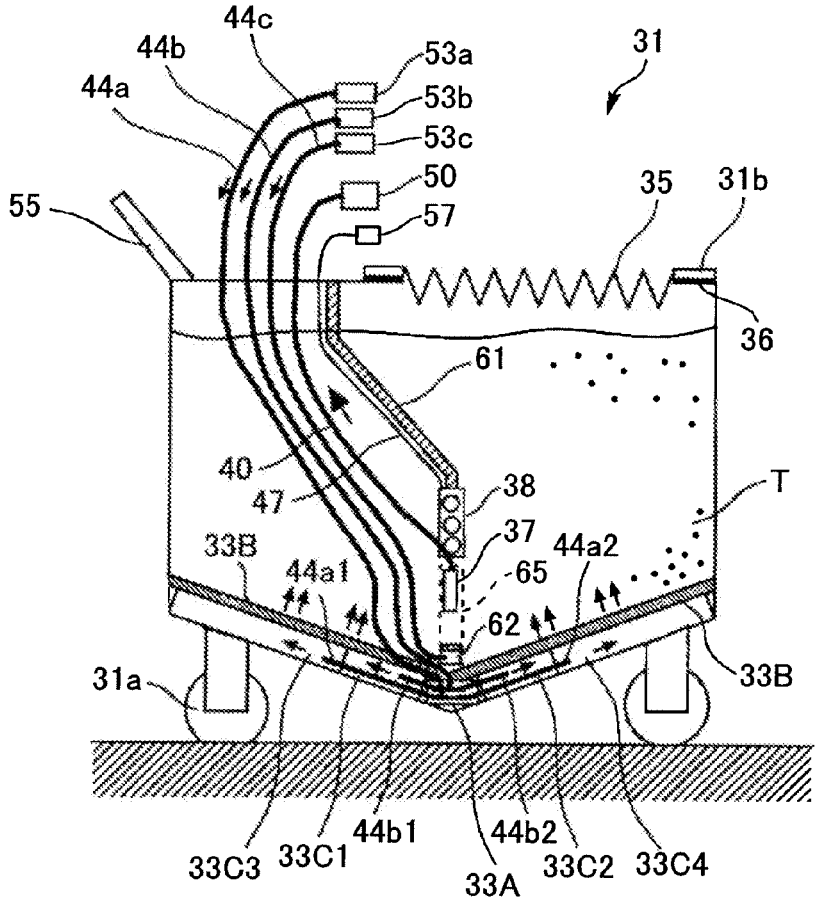
FIG. 29 is a diagram showing a configuration of a particle accommodating unit of a particle accommodating apparatus according to a seventh embodiment of the present invention.
Figure 30:
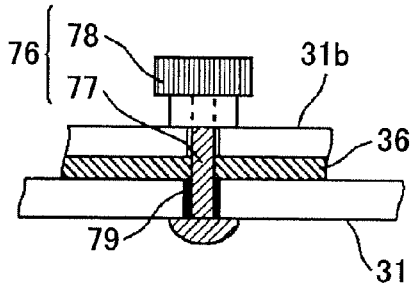
FIG. 30 is a partial enlarged view of the particle accommodating unit shown in FIG. 29.

FIG. 29 is a diagram showing a configuration of a particle accommodating unit of a particle supply apparatus according to the seventh embodiment. It is noted that the illustration of the seventh embodiment shown in FIG. 29 corresponds to the illustration of the fifth embodiment shown in FIG. 21. FIG. 30 is a diagram showing in detail a portion of the particle accommodating unit of FIG. 29 where a lid is fastened with a knob screw (knob nut). It is noted that the differences between the particle accommodating unit according to the seventh embodiment and that according to the fifth embodiment mainly lie in the configurations of the filter and the seal member and the manner in which the lid is fastened.

Specifically, as with the fifth embodiment, the particle supply apparatus according to the seventh embodiment includes a particle supply apparatus main frame 21 having a particle accommodating unit 31, a pump 22 for conveying toner T accommodated in the particle accommodating unit 31 toward a toner hopper 9, an air pump 24 for supplying air to a gas spouting unit 33 and a second gas spouting unit 62, and a power supply unit 60, for example. As is shown in FIG. 29, the particle accommodating unit 31 according to the seventh embodiment includes a suction pipe 37; the gas spouting unit 33 that is made up of an intermediate unit 33A, a porous member 33B, and first through fourth chambers 33C1-33C4; four tubes 40, 44*a*-44*c*, the second gas spouting unit 62, a holding member 65, a remaining toner sensor 38, a cable 47, and a support 61, for example.

Also, an opening and a filter 35 covering the opening (gas discharge unit) are arranged at the ceiling portion of the particle accommodating unit 31. The filter 35 and the opening prevent the internal pressure of the particle accommodating unit 31 from increasing due to the air supplied thereto from the gas spouting unit 33 and the second gas spouting unit 62.

In the seventh embodiment, the filter 35 is made of unwoven fabric made of polyester (e.g. Acstar by Toray Co., Ltd.). Such unwoven fabric is relatively inexpensive and is capable of effectively preventing the internal pressure of the particle accommodating unit 31 from increasing.

Also, in the seventh embodiment, the filter 35 has an accordion-like folded structure. With such a structure, the surface area of the filter 35 may be increased compared to a filter with a flat surface such as the filter 35 shown in FIG. 21 so that the filtering efficiency may be enhanced, for example.

It is noted that although the filter 35 used in the seventh embodiment is arranged into an accordion-like folded structure, the filter 35 may alternatively have a wavy structure to achieve similar advantages such as improved filtering performance, for example.

Also, the filter 35 and the opening (gas discharge unit) are arranged at a lid 31*b* that is detachably mounted to a ceiling portion of the particle accommodating unit 31 as in the fifth embodiment. In the seventh embodiment, the lid 31*b* is fastened to the particle accommodating unit 31 by plural knob screws 76 via a seal member 36 made of silicon sponge, which is a soft and flexible material with good sealing properties.

With such an arrangement, fatigue and wear of the seal member 36 may be reduced even when the lid 31*b* is repeatedly detached from the particle accommodating unit 31 and overall sealing properties of the particle accommodating unit 31 may be secures so that toner may be prevented from scattering to the exterior, for example.

In the following, a method for fastening the lid 31*b* to the ceiling portion of the particle accommodating unit 31 is described with reference to FIG. 30.

As is described above, the lid 31*b* is fixed to the particle accommodating unit by plural knob screws 76 arranged at plural locations along the periphery of the opening formed at the ceiling portion of the particle accommodating unit 31.

Specifically, plural screw holes are formed along the periphery of the opening at the ceiling portion of the particle accommodating unit 31, and male screw parts 77 of the knob screws 76 are screwed into the screw holes from the bottom surface of the ceiling portion of the particle accommodating unit 31. That is, the screw heads of the male screw parts 77 are arranged to face the lower side of the ceiling portion. The male screw parts 77 are fixed to the particle accommodating unit 31 by dot welding, and caulk 79 is used to seal the gap between the screw thread of the male screw part 77 and the screw thread of the screw hole so that toner may be prevented from penetrating through such gap and scattering to the exterior, for example.

The male screw parts 77 protrude upward from the ceiling portion of the particle accommodating unit 31, and the lid 31*b* and the seal member 36 that both have through holes for enabling the male screw parts 77 to penetrate therethrough are detachably mounted to the particle accommodating unit 31. Specifically, the seal member 36 and the lid 31*b* are set in place by the male screw parts 77 protruding from the ceiling portion of the particle accommodating unit 31. The male screw parts 77 penetrate through the holes formed on the seal member 36 and the lid 31*b* to protrude from the upper face of the lid 31*b*, and female screw parts (knob nuts) 78 of the knob screws 76 are screwed onto the male screw parts 77 from the upper side of the lid 31*b*. In this way, the lid 31*b* may be fixed to the particle accommodating unit 31 via the seal member 36. In a preferred embodiment, the female screw parts (knob nuts) 78 have grippers arranged thereon so that an operator may not have to use any tool to screw the female screw parts 78 onto the male screw parts 77. It is noted that the seal member 36 may be adhered to the lid 31*b* side or the particle accommodating unit 31 side.

By fixing the lid 31*b* to the particle accommodating unit 31 in the manner described above, the lid 31*b* may be attached/detached to/from the particle accommodating unit 31 with relative ease. Specifically, the knob screws 76 may be fastened/unfastened without requiring use of any particular tool so that the time required for attaching/detaching the lid 31*b* may be reduced, for example. It is particularly noted that in a case where the lid 31*b* is arranged to have a relatively large area in order to improve the performance of toner replenishing operations, a relatively large number of fastening members (screws) are preferably used to fix the lid 31*b* to the particle accommodating unit 31 so that adequate seal may be secured between the lid 31*b* and the particle accommodating unit 31. In such a case, the knob screws 76 according to the present embodiment may be effectively used as the fastening members to reduce the time required for attaching/detaching the lid 31*b*, for example.

Also, by arranging the knob screws 76 so that the male screw parts 77 protrude toward the outer side of the particle accommodating unit 31, metal particles that may be generated from screwing the female screw parts 78 onto the male screw parts 77 may be prevented from penetrating into the particle accommodating unit 31 to be mixed with the toner T accommodated therein, for example. It is noted that in a case where a female screw part is arranged at the inner ceiling portion of the particle accommodating unit 31 and a male screw part is screwed onto the female screw from the outer side of the particle accommodating unit 31 toward the inner side, metal particles generated by screwing together the female and male screw parts may be mixed with the toner accommodated in the particle accommodating unit 31 to cause imaging defects, for example. In this respect, according to the seventh embodiment, measures are implemented to prevent such metal particles generated at the knob screws 76 from entering the particle accommodating unit 31.

Also, by applying the caulk 79 to the gap formed between the ceiling portion of the particle accommodating unit 31 and the male screw part 77 (caulking process) after the male screw part 77 is welded to the ceiling portion, the seal between the male screw part 77 and the ceiling portion may be improved so that toner may be prevented from bursting out through the gap between the male screw part 77 and the ceiling portion from the particle accommodating unit 31 that may be in a pressurized state, for example. Further, since the male screw parts 77 are arranged to protrude toward the outer side of the particle accommodating unit 31, the caulking process (i.e., application of the caulk 79 to the gap between the male screw part 77 and the ceiling portion) does not have to be performed every time the lid 31*b* is opened/closed (i.e., detached/attached). In this way, operations for opening/closing the lid 31*b* may be efficiently performed, and cases may be prevented where an operator inadvertently fails to perform the caulking process to thereby cause toner scattering, for example. Also, since the male screw parts 77 subject to the caulking process are arranged to protrude toward the outer side of the particle accommodating unit 31, stray bits and pieces of the caulk 79 may be prevented from entering the particle accommodating unit 31 and mixing with the toner accommodated therein.

It is noted that in the seventh embodiment, the caulk 79 is applied to the gap between the male screw part 77 and the ceiling portion of the particle accommodating unit 31; however, in an alternative embodiment, solder may be used to fill the gap between the male screw part 77 and the ceiling portion (soldering process) to obtain similar advantages as described above.

Also, it is noted that in the seventh embodiment, the knob screws 76 (knob nuts 78) are used to fix the lid 31*b* to the ceiling portion of the particle accommodating unit 31; however, in an alternative embodiment clamps may be used to fix the lid 31*b* to the ceiling portion of the particle accommodating unit 31. Even in such an alternative embodiment, the lid 31*b* may be attached/detached to/from the particle accommodating unit 31 without using any tool so that the attaching/detaching operations time may be reduced. Also, it is noted that in the case of using such clamps, metal particles may not be generated and application of caulk may be unnecessary so that penetration of impurities into the toner accommodated within the particle accommodating unit 31 may be effectively prevented, for example.

Also, as in the case of the previously described embodiments, according to the seventh embodiment of the present invention, air is spouted from the bottom of the particle accommodating unit 31 by the gas spouting unit 33 while toner T within the particle accommodating unit 31 is introduced into the suction pipe 37 to be conveyed to the toner hopper 9 (supply destination), and the filter 35 (gas discharge unit) is arranged at the particle accommodating unit 31 in order to prevent the internal pressure of the particle accommodating unit 31 from increasing. In this way, the accommodating capacity of the toner T may be increased without causing damage to the toner T or requiring complicated replacement operations, fine adjustment of the toner supply amount may be performed, and the toner T may be prevented from scattering to be efficiently and accurately conveyed to the toner hopper 9, for example.

It is noted that in the above-described fifth through seventh embodiments, the particle supply apparatus 20 that supplies toner to a supply destination is illustrated as an exemplary particle supply apparatus; however, the present invention is not limited to such an example, and may also be applied to a particle supply apparatus that supplies a two-component developer consisting of toner and a carrier to a supply destination, for example. In this case, a magnetic permeability sensor may be used for detecting the amount of developer remaining in the particle accommodating unit, for example.

Further, the present invention may equally be applied to other types of particle supply apparatuses including but not limited to the following:

(1) Particle supply apparatus that supplies mold material (e.g. pellet) to a resin molding machine
(2) Particle supply apparatus that transports flour, fertilizer, or livestock feed, for example
(3) Particle supply apparatus used in a production site for conveying medicine in the form of powder, liquid, or tablets, for example
(4) Particle supply apparatus that transports cement
(5) Particle supply apparatus that conveys industrial paint by dispersing air into the industrial paint to reduce its viscosity
(6) Particle supply apparatus that conveys industrial glass beads used as components of road paint or internal filling of an air bed, for example In the case where the present invention is applied to a particle supply apparatus that transfers hard particles such as the two-component developer or glass beads, the gas spouting unit (fluidized bed) 33 may be prone to damage over time when it is made of resin material such as PE or PC, and the holes of the porous member 33B may possibly be clogged as a result, for example. Thus, in such a case, the gas spouting unit 33 is preferably made of a sintered copper/steel member or a fine metal mesh filter, for example.

Also, it is noted that in the above-described fifth through seventh embodiments of the present invention, a diaphragm air pump is used as the pump 22 for attracting the toner within the particle accommodating unit 31 by suction and discharging the toner to the toner hopper 9. However, the present invention is not limited to such an embodiment, and other types of pumps such as a screw pump may be used as well.

Also, it is noted that in the above-described fifth through seventh embodiments of the present invention, the particle supply apparatus 20 is arranged outside the imaging apparatus main frame 1. However, the present invention is not limited to such an embodiment, and the particle supply apparatus 20 may alternatively be arranged within the imaging apparatus main frame 1.

Although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

What is claimed is:

1. A particle supply apparatus comprising:

a particle accommodating unit that accommodates particles;

a gas spouting unit that is arranged at a bottom portion of the particle accommodating unit and is configured to spout gas toward the particles;

a conveying mechanism that applies suction to the particles accommodated in the particle accommodating unit and conveys the particles toward a supply destination; and a gas discharge unit that discharges gas contained within the particle accommodating unit toward an exterior side of the particle accommodating unit, the gas discharge unit including a porous filter, wherein the gas spouting unit includes a gas spouting outlet that is made of a porous member; and a gross area of holes the porous filter is arranged to be greater than a gross area of holes of the porous member of the gas spouting unit.

2. The particle supply apparatus as claimed in claim 1, wherein the gas discharge unit is arranged above a particle load line that is formed when the particles are accommodated in the particle accommodating unit up to a maximum accommodating capacity of the particle accommodating unit.

3. The particle supply apparatus as claimed in claim 1, wherein the gas discharge unit includes an opening formed at the particle accommodating unit and a filter covering said opening.

4. The particle supply apparatus as claimed in claim 1, wherein the gas discharge unit is arranged at a lid of the particle accommodating unit which lid is detachably arranged at a ceiling portion of the particle accommodating unit.

5. The particle supply apparatus as claimed in claim 1, wherein the particle accommodating unit is detachably mounted to a particle supply apparatus main frame.

6. The particle supply apparatus as claimed in claim 1, wherein the bottom portion of the particle accommodating unit is arranged into a sloping surface having a center region located at a lowermost position.

7. The particle supply apparatus as claimed in claim 1, wherein the conveying mechanism includes a suction unit that attracts the particles accommodated in the particle accommodating unit in an upward direction by suction.

8. The particle supply apparatus as claimed in claim 7, wherein the suction unit corresponds to a pump that is arranged above the particle accommodating unit and the supply destination, the pump being configured to discharge the attracted particles toward the supply destination.

9. The particle supply apparatus as claimed in claim 1, wherein the gas spouting unit includes a gas spouting outlet that is made of a porous member.

10. The particle supply apparatus as claimed in claim 1, wherein the particles correspond to toner.

11. The particle supply apparatus as claimed in claim 1, wherein the particles correspond to a two-component developer that is made up of toner and a carrier.

12. A particle supply apparatus comprising:

a particle accommodating unit that accommodates particles;

a gas spouting unit that is arranged at a bottom portion of the particle accommodating unit and is configured to spout gas toward the particles;

a conveying mechanism that applies suction to the particles accommodated in the particle accommodating unit and conveys the particles toward a supply destination; and a gas discharge unit that discharges gas contained within the particle accommodating unit toward an exterior side of the particle accommodating unit, wherein the gas discharge unit is arranged at a lid of the particle accommodating unit which lid is detachably arranged at a ceiling portion of the particle accommodating unit, wherein the lid is fastened to the ceiling portion of the particle accommodating unit by a knob screw, and wherein the knob screw includes a male screw part that is fixed to the ceiling portion via a caulk and a female screw part that has a gripper and is screwed to a portion of the male screw part that penetrates a through hole formed at the lid and protrudes from said through hole.

13. A particle supply apparatus comprising:

a particle accommodating unit that accommodates particles;

a gas spouting unit that is arranged at a bottom portion of the particle accommodating unit and is configured to spout gas toward the particles;

a conveying mechanism that applies suction to the particles accommodated in the particle accommodating unit and conveys the particles toward a supply destination; and a gas discharge unit that discharges gas contained within the particle accommodating unit toward an exterior side of the particle accommodating unit, wherein the bottom portion of the particle accommodating unit is arranged into a sloping surface having a center region located at a lowermost position, and wherein the gas spouting unit is arranged such that a gas spouting amount per unit area per unit time at a lowermost region of the sloping surface is greater than a gas spouting amount per unit area per unit time at other regions of the sloping surface.

14. An imaging apparatus comprising:

a particle supply apparatus including a particle accommodating unit that accommodates particles;

a gas spouting unit that is arranged at a bottom portion of the particle accommodating unit and is configured to spout gas toward the particles;

a conveying mechanism that applies suction to the particles accommodated in the particle accommodating unit and conveys the particles toward a supply destination; and a gas discharge unit that discharges gas contained within the particle accommodating unit toward an exterior side of the particle accommodating unit, the gas discharge unit including a porous filter, wherein the gas spouting unit includes a gas spouting outlet that is made of a porous member;

and a gross area of holes of the porous filter is greater than a gross area of holes of the porous member of the gas spouting unit.

* * * * *